US009476672B2

(12) United States Patent
Wells et al.

(10) Patent No.: US 9,476,672 B2
(45) Date of Patent: Oct. 25, 2016

(54) ACCESSORY MOUNTING HAND GUARD FOR FIREARM

(71) Applicant: SureFire, LLC, Fountain Valley, CA (US)

(72) Inventors: William Wells, Costa Mesa, CA (US); Michael D. Picciotta, Yorba Linda, CA (US); George Syrengelas, Garden Grove, CA (US); Lance Graham, Oceanside, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 14/578,229

(22) Filed: Dec. 19, 2014

(65) Prior Publication Data

US 2015/0135576 A1 May 21, 2015

Related U.S. Application Data

(63) Continuation-in-part of application No. 13/739,478, filed on Jan. 11, 2013, now Pat. No. 9,127,906, which is a continuation-in-part of application No. 13/451,755, filed on Apr. 20, 2012, now Pat. No. 8,595,970.

(60) Provisional application No. 61/925,924, filed on Jan. 10, 2014.

(51) Int. Cl.

| | |
|---|---|
| ***F41C 27/00*** | (2006.01) |
| ***F41C 23/16*** | (2006.01) |
| ***F41G 11/00*** | (2006.01) |

(52) U.S. Cl.

CPC ..... *F41C 23/16* (2013.01); *F41G 11/003* (2013.01); *Y10T 29/49826* (2015.01); *Y10T 29/49963* (2015.01)

(58) Field of Classification Search

CPC ..... F41C 23/16

See application file for complete search history.

(56) References Cited

U.S. PATENT DOCUMENTS

| | | | |
|---|---|---|---|
| 3,090,150 | A | 5/1963 | Stoner |
| 4,536,982 | A | 8/1985 | Bredbury et al. |

(Continued)

FOREIGN PATENT DOCUMENTS

| | | |
|---|---|---|
| WO | WO 2008/103193 | 8/2008 |
| WO | WO 2009/082520 | 7/2009 |

OTHER PUBLICATIONS

Stickman, "Noveske NSR-11", GEARSCOUT MilitaryTimes, Jan. 18, 2012, 5 pages [online], [retrieved on May 15, 2015]. Retrieved from the Internet: <URL: http://gearscout.militarytimes.com/2012/01/18/noveske-nsr-11/ >.

(Continued)

*Primary Examiner* — Gabriel Klein

(74) *Attorney, Agent, or Firm* — Haynes and Boone, LLP

(57) ABSTRACT

Hand guards for firearms and related methods are provided. In one example, a hand guard for a firearm includes an elongated tubular housing having a lumen extending between opposite ends thereof. A hand guard mounting assembly is coupled concentrically to a rear end portion of the housing. The mounting assembly includes a pair of opposing transverse surfaces respectively disposed on opposite sides of a transverse flange located on a front end of a barrel nut extending forwardly from a receiver of the firearm. At least one of the transverse surfaces is longitudinally moveable toward the other transverse surface. A mechanism adjustably urges the at least one transverse surface longitudinally toward the other transverse surface so as to clamp the flange firmly between the two transverse surfaces and such that the barrel of the firearm is disposed concentrically within the lumen of the housing.

20 Claims, 36 Drawing Sheets

(56) References Cited

U.S. PATENT DOCUMENTS 5,412,895 A * 5/1995 Krieger ..... F41A 21/482 42/75.02
6,508,027 B1 1/2003 Kim
D477,855 S 7/2003 Selvaggio
6,671,990 B1 1/2004 Booth
6,694,660 B1 2/2004 Davies
6,779,288 B1 8/2004 Kim
7,191,557 B2 3/2007 Gablowski et al.
7,216,451 B1 5/2007 Troy
D556,289 S 11/2007 Yu
7,363,741 B2 4/2008 DeSomma et al.
D590,473 S 4/2009 Fitzpatrick et al.
D606,614 S 12/2009 Fitzpatrick et al.
7,640,689 B2 1/2010 Fluhr
7,707,762 B1 5/2010 Swan
7,716,865 B2 5/2010 Daniel et al.
7,770,317 B1 * 8/2010 Tankersley ..... F41C 23/16 42/71.01
D636,453 S 4/2011 Fitzpatrick et al.
7,941,959 B1 5/2011 Swan
D639,376 S 6/2011 Ding
8,037,663 B2 10/2011 Jensen
8,046,949 B1 11/2011 Daniel
8,069,604 B2 12/2011 Larue
8,091,265 B1 1/2012 Teetzel et al.
D656,215 S 3/2012 Fitzpatrick et al.
8,234,809 B2 8/2012 Daniel
8,276,303 B2 10/2012 Kapusta et al.
D670,782 S 11/2012 Barrett
8,336,243 B2 12/2012 Langevin et al.
8,359,779 B2 1/2013 Daniel et al.
8,448,367 B2 5/2013 Samson et al.
8,453,364 B2 6/2013 Kucynko
8,464,457 B2 6/2013 Troy et al.
8,595,970 B2 12/2013 Picciotta et al.
8,607,490 B1 12/2013 Zinsner
D699,807 S 2/2014 Lee
D702,792 S 4/2014 Burt et al.
D703,286 S 4/2014 Chen et al.
8,726,558 B1 5/2014 Nason
D708,694 S 7/2014 Wells et al.
8,769,853 B1 7/2014 LaRue
D721,407 S 1/2015 Chu
8,925,236 B1 1/2015 Mayberry et al.
8,931,196 B1 1/2015 Larue
D722,356 S 2/2015 Keller et al.
2005/0000142 A1 1/2005 Kim et al.
2007/0017139 A1 * 1/2007 Larue ..... F41C 23/16 42/75.1
2007/0199435 A1 8/2007 Hochstrate et al.
2008/0092422 A1 * 4/2008 Daniel ..... F41C 23/16 42/90
2008/0301994 A1 12/2008 Langevin et al.
2009/0038198 A1 2/2009 Yu
2010/0126054 A1 5/2010 Daniel et al.
2010/0319231 A1 12/2010 Stone et al.
2011/0016762 A1 1/2011 Davies
2011/0061281 A1 * 3/2011 Kapusta ..... F41C 23/16 42/71.01
2011/0107643 A1 5/2011 Fitzpatrick et al.
2011/0126443 A1 * 6/2011 Sirois ..... F41C 23/16 42/90
2011/0252625 A1 * 10/2011 Daniel ..... F41C 23/16 29/525.01
2012/0036756 A1 2/2012 Brown
2012/0111183 A1 5/2012 Hochstrate et al.
2012/0124880 A1 5/2012 Leclair
2012/0132068 A1 5/2012 Kucynko
2012/0180358 A1 7/2012 Samson et al.
2012/0186123 A1 * 7/2012 Troy ..... F41G 11/003 42/71.01
2012/0317859 A1 12/2012 Brown
2012/0324775 A1 12/2012 Troy et al.
2013/0097910 A1 * 4/2013 Daniel ..... F41C 23/16 42/72
2013/0180151 A1 * 7/2013 Moore ..... F41C 27/00 42/90
2013/0205637 A1 8/2013 Patel
2013/0263732 A1 10/2013 Kucynko
2013/0276341 A1 10/2013 Wells et al.
2014/0130390 A1 5/2014 Geissele

OTHER PUBLICATIONS

Wells et al. "Weapon Attachment", Design U.S. Appl. No. 29/479,013, filed Jan. 10, 2014, 10 pages.
Extended European Search Report, Application No. 13164598.8, Jun. 1, 2015, 10 pages.
Extended European Search Report, Application No. 13164599.6, Jun. 1, 2015, 9 pages.
Extended European Search Report, Application No. 15150538.5, Jun. 19, 2015, 9 pages.

* cited by examiner

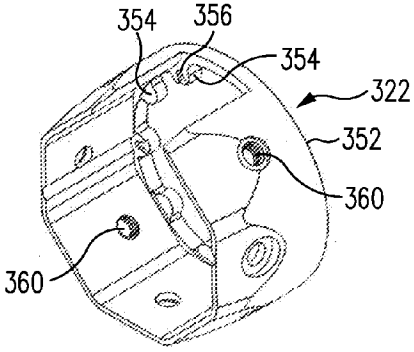
FIG. 35A
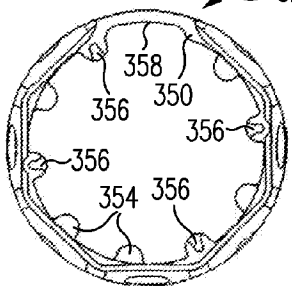
FIG. 35B
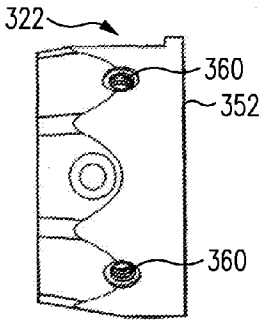
FIG. 35C
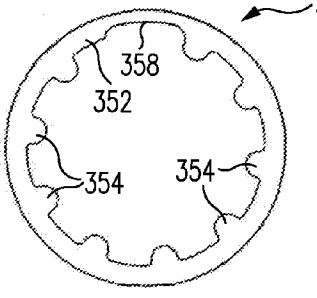
FIG. 35D
FIG. 36A
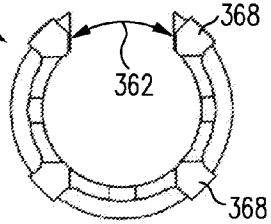
FIG. 36B
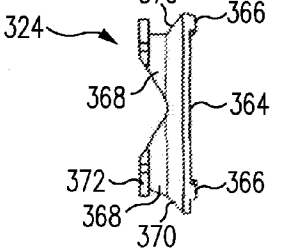
FIG. 36C
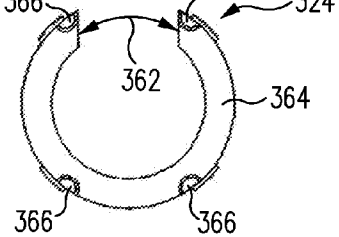
FIG. 36D
FIG. 37A
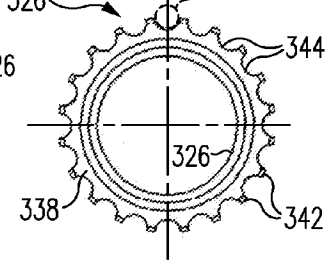
FIG. 37B
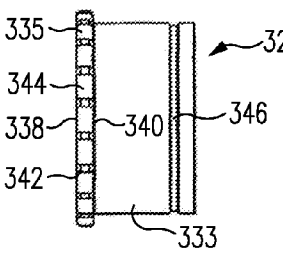
FIG. 37C
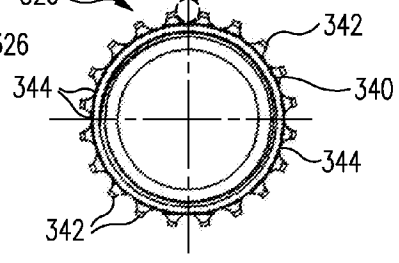
FIG. 37D

ACCESSORY MOUNTING HAND GUARD FOR FIREARM

CROSS-REFERENCE TO RELATED APPLICATIONS

This application claims the benefit of U.S. Provisional Patent Application No. 61/925,924 filed Jan. 10, 2014, which is hereby incorporated by reference in its entirety.

This application is a continuation-in-part of U.S. patent application Ser. No. 13/739,478 filed Jan. 11, 2013, which is a continuation-in-part of U.S. patent application Ser. No. 13/451,755 filed Apr. 20, 2012 (now U.S. Pat. No. 8,595,970 issued Dec. 3, 2013), all of which are hereby incorporated by reference in their entirety.

BACKGROUND

1. Technical Field

This invention relates to firearms in general, and in particular, to hand guards for firearms that enable various accessories to be mounted thereon reliably and efficiently.

2. Related Art

Firearms, such as the M16 and M4 rifles adopted for use by the U.S. military services, typically incorporate a hand guard made of a plastic or composite material, by which the shooter can effectively grasp a forward portion of the barrel of the weapon, e.g., for carrying, aiming and shooting the weapon effectively. Additionally, it is recognized that such firearms can often benefit from a variety of shooting accessories coupled to the weapon, such as lights for illuminating targets or sighting devices, e.g., laser targeting devices. Responsively, the prior art is replete with examples of devices, including hand guards adapted to replace the stock hand guard provided on the rifle, that are designed to enable one or more accessories to be coupled to the weapon.

However, these prior art devices and hand guards are not free of problems. For example, some rely on complicated mechanisms for coupling the hand guards to the rifle that can result in an unreliable mounting of the hand guard on the rifle, typically accompanied by a lengthy amount of time needed to mount the hand guard on the weapon. In other instances in which the hand guard mounts on the barrel of the rifle, the forces applied to the barrel in mounting the hand guard to it can twist or deform the barrel such that the accuracy of the rifle is adversely affected.

Accordingly, a need exists for hand guard designs that enable a variety of useful accessories to be mounted on a firearm, together with methods for mounting the hand guards on the firearm quickly, reliably and without adversely affecting their accuracy.

SUMMARY

In accordance with various embodiments described herein, hand guards that permit a variety of useful accessories to be mounted on firearms are provided, together with methods for mounting the hand guards on the firearms quickly, reliably and without adversely affecting their accuracy.

In one embodiment, a hand guard for a firearm, such as a rifle, includes an elongated tubular housing comprising an upper part, a lower part, opposite open ends, and an elongated lumen configured to receive an intermediate portion of a barrel of a firearm longitudinally therein. An expansion collar is disposed at one end of the housing. The expansion collar includes an expansion mechanism configured to adjustably compress the expansion collar and the lower part of the housing longitudinally between a pair of surfaces respectively disposed at opposite ends of the intermediate portion of the barrel.

In another embodiment, a method for using a hand guard with a firearm comprises providing an elongated tubular housing comprising an upper part, a lower part, opposite open ends, and a lumen configured to receive an intermediate portion of a barrel of the firearm longitudinally therein. An expansion collar is also provided. The collar has a longitudinally extending tongue and an expansion mechanism configured to adjustably compress the expansion collar and the lower part of the housing longitudinally between a pair of surfaces respectively disposed at opposite ends of the intermediate portion of the barrel. The tongue of the collar is inserted into an end of the housing to form an assembly, and the assembly is mounted onto a lower surface of the intermediate portion of the barrel and between the surfaces thereon. The expansion mechanism of the collar is then adjusted such that the assembly is held in compression between the surfaces.

In another embodiment, a hand guard includes an elongated housing. The elongated housing comprises a lumen configured to substantially surround an intermediate portion of a barrel of a firearm, a side wall, and a pair of elongated slots disposed on opposite sides of the side wall. Each of the elongated slots defines a corresponding angulated face of a rail adapted to receive an accessory to be mounted thereon. For example, the rail may be a reduced-height Picatinny rail provided by the side wall of the housing.

In another embodiment, a method includes inserting at least a portion of an expansion collar into an end of a part of a housing to form an assembly; positioning the assembly over an intermediate portion of a barrel of a firearm and between opposing surfaces thereon; and adjusting an expansion mechanism of the expansion collar such that the assembly is held in compression between the opposing surfaces by advancing a plurality of longitudinally extending screws respectively received in corresponding ones of a plurality of bores contained in the expansion collar such that a distal end of each screw is disposed in abutment with a bottom end surface of a corresponding one of the bores and at least a portion of each screw is loaded in compression.

In another embodiment, a hand guard for a firearm includes an elongated tubular housing having a lumen extending between opposite ends thereof. A hand guard mounting assembly is coupled concentrically to a rear end portion of the housing. The mounting assembly includes a pair of opposing transverse surfaces respectively disposed on opposite sides of a transverse flange located on a front end of a barrel nut extending forwardly from a receiver of the firearm. At least one of the transverse surfaces is longitudinally moveable toward the other transverse surface. A mechanism adjustably urges the at least one transverse surface longitudinally toward the other transverse surface so as to clamp the flange firmly between the two transverse surfaces and such that the barrel of the firearm is disposed concentrically within the lumen of the housing.

In another embodiment, a hand guard is provided for a firearm of a type that includes a barrel and a barrel nut extending longitudinally forward from a receiver of the firearm. The hand guard includes an elongated tubular housing having a lumen extending between opposite ends of the housing; a mounting assembly coupled concentrically to a rear end portion of the housing, the mounting assembly including a pair of opposing transverse surfaces respectively disposed on opposite sides of a transverse flange located on a front end of the barrel nut, at least one of the transverse surfaces being longitudinally moveable toward the other transverse surface so as to clamp the flange firmly between the two transverse surfaces and such that the barrel of the firearm is disposed concentrically within the lumen of the housing; and a mechanism for adjustably urging the at least one transverse surface longitudinally toward the other transverse surface.

In another embodiment, a method is provided for attaching a hand guard to a firearm of a type that includes a barrel, a barrel nut, and a forwardly biased slip ring extending longitudinally forward from a receiver of the firearm. The method includes providing an elongated tubular housing having a lumen extending between opposite ends of the housing and defining at least one accessory mounting rail on an upper surface thereof; and coupling a hand guard mounting assembly to a rear end portion of the housing, the hand guard mounting assembly including: an annular barrel nut interface having a flange extending radially inward at a rear end thereof; the flange defining a forward facing surface comprising at least one tab extending radially inward and conforming in size, shape and location to at least one scallop extending radially inward into a flange located on a front end of the barrel nut; the forward facing surface of the at least one tab having at least one indentation configured to receive a tine extending radially outward from the flange longitudinally therein; and a wedge ring disposed concentrically within the barrel nut interface, the wedge ring defining a rearward facing surface having at least one rearwardly extending land disposed thereon, the at least one land conforming in size, shape and location to the at least one scallop of the flange, and at least one inclined plane disposed on the wedge ring in front of the rearward facing surface and below at least one radially extending set screw disposed in the barrel nut interface.

The scope of the invention is defined by the claims, which are incorporated into this section by reference. A more complete understanding of embodiments of the invention will be afforded to those skilled in the art, as well as a realization of additional advantages thereof; by a consideration of the following detailed description of one or more embodiments. Reference will be made to the appended sheets of drawings that will first be described briefly.

BRIEF DESCRIPTION OF THE SEVERAL VIEWS OF THE DRAWINGS

FIG. 35A is an upper and left side perspective view of a barrel nut interface of the example hand guard mounting assembly;

FIG. 35B is a front end elevation view of the barrel nut interface;

FIG. 35C is a left side elevation view thereof;

FIG. 35D is a rear end elevation view thereof;

FIG. 36A is an upper and left side perspective view of a wedge ring of the example mounting assembly;

FIG. 36B is a front end elevation view of the example wedge ring;

FIG. 36C is a left side elevation view thereof;

FIG. 36D is a rear end elevation view thereof;

FIG. 37A is an upper and left side perspective view of a barrel nut of a type utilized in a host rifle, with which the example hand guard and hand guard mounting assembly of the present invention interface;

FIG. 37B is a front end elevation view of the barrel nut;

FIG. 37C is a left side elevation view thereof;

FIG. 37D is a rear end elevation view thereof;

Embodiments of the invention and their advantages are best understood by referring to the detailed description that follows. It should be appreciated that like reference numerals are used to identify like elements illustrated in one or more of the figures.

DETAILED DESCRIPTION

Figure 1A:
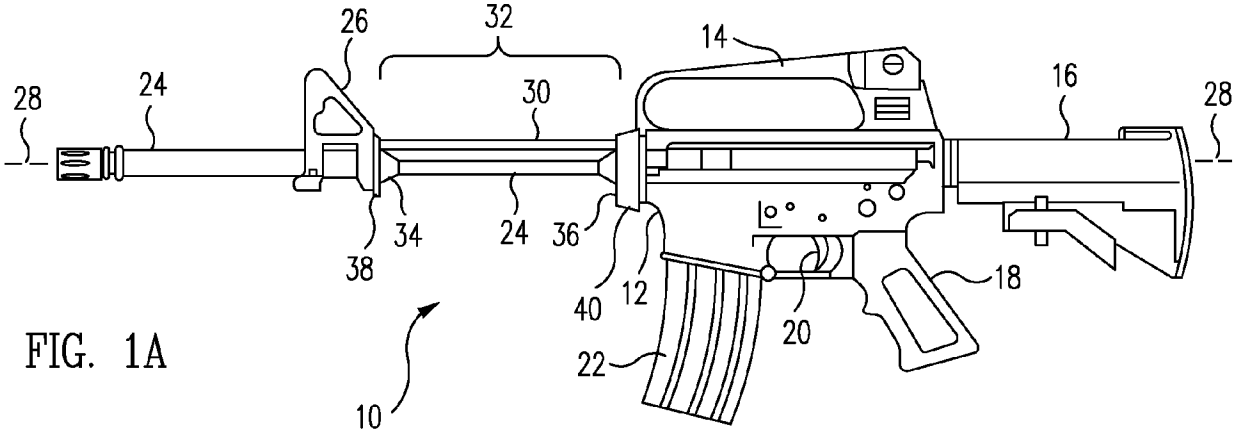
FIG. 1A is left side elevation view of an example firearm, namely, an M-16 rifle, of a type to which various hand guards of the present disclosure may be advantageously applied, in which a conventional hand guard has been omitted to reveal a gas tube and an intermediate portion of a barrel thereof, in accordance with an embodiment of the disclosure.

FIG. 1A is left side elevation view of an example firearm, namely, an M-16 rifle 10, of a type with which embodiments of the novel hand guard of the present disclosure can be advantageously utilized. The M16, and a variant thereof, viz., the M4, has generally replaced the M14 and M1 carbine as the standard infantry rifles of the U.S. armed forces. Currently, the M16 is the most commonly manufactured 5.56×45 mm rifle in the world, and is in use by 15 NATO countries and more than 80 countries worldwide. Numerous companies in the United States, Canada, and China have, together, produced more than 8,000,000 M-16 rifles, in all of its many variants, of which approximately 90% are still in operation.

As can be seen in FIG. 1A, the example rifle 10 includes a receiver 12 having a combined carrying handle and rear sight 14, a rear or shoulder stock 16 extending rearwardly from the receiver 12, a pistol-type hand grip 18, a trigger 20 for firing the rifle 10, a magazine 22 for holding ammunition, an elongated barrel 24 extending forwardly from the receiver 12, an upstanding front sight 26 mounted forwardly on the barrel 24, and a longitudinal axis 28 concentric with the barrel 24. Extending rearwardly from the front sight 26 to the receiver 12 is a gas tube 30 that conveys combustion gases from a port (not seen in FIG. 1A) in the barrel 24 located below the front sight 26 to the receiver 12, which are used by components in the receiver for the automatic actuation of the rifle 10 when it is fired.

The example rifle 10 also conventionally includes a hand guard, typically made of a plastic composite, that surrounds the gas tube 30 and an intermediate portion 32 of the barrel 24. However, in FIG. 1A, the conventional hand guard has been omitted for purposes of explication. As illustrated in FIG. 1A, the intermediate portion 32 of the barrel 24 includes a pair of front and rear radial surfaces 34 and 36 respectively disposed at opposite ends thereof. The front radial surface 34 comprises the rear surface of a hand guard forward support cap 38, and the rear radial surface 36 comprises the front surface of a threaded hand guard rear slip ring retainer 40 (also referred to as a barrel nut). As discussed in more detail below, the two radial surfaces 34 and 36 disposed at the opposite ends of the intermediate portion 32 of the barrel 24 can, in some embodiments, provide features that are advantageous for mounting a hand guard 100 in accordance with the present disclosure on the rifle 10.

Figure 1B:
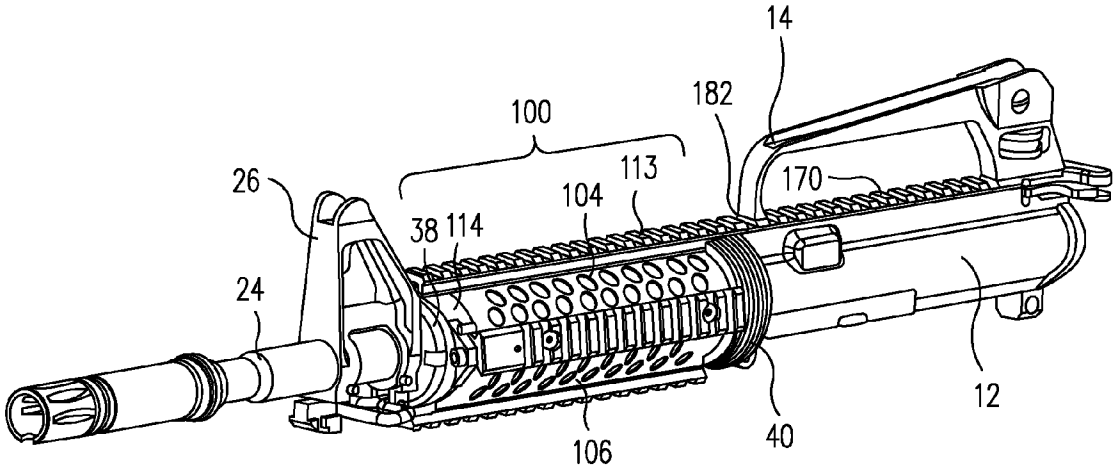
FIG. 1B is an upper, front, left side perspective view of the receiver and barrel of the rifle of FIG. 1A, showing a first example embodiment of a hand guard in accordance with the present disclosure mounted thereon.
Figure 2:
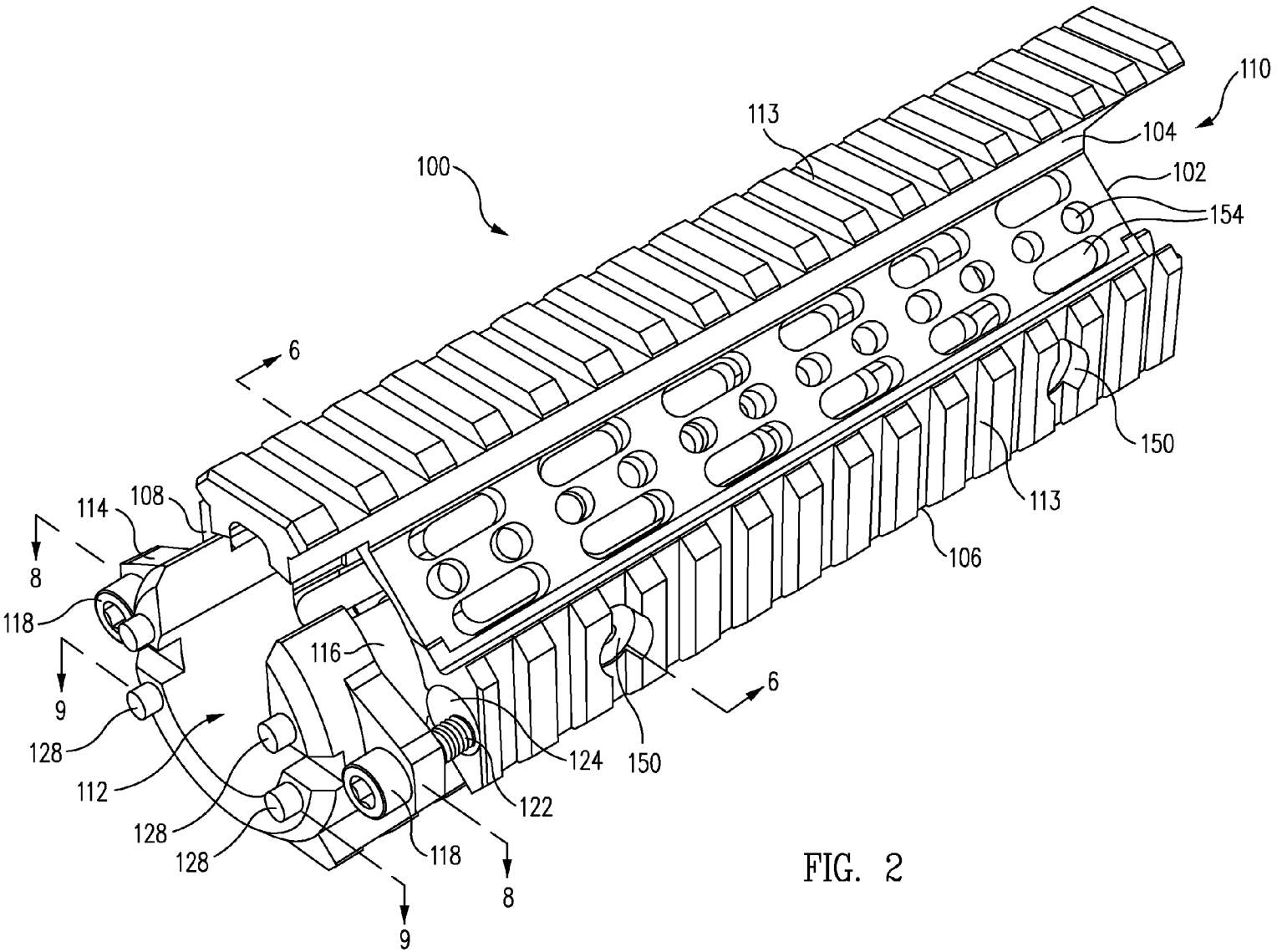
FIG. 2 is an upper, front, left side perspective view of the first example hand guard of FIG. 1B.
Figure 3:
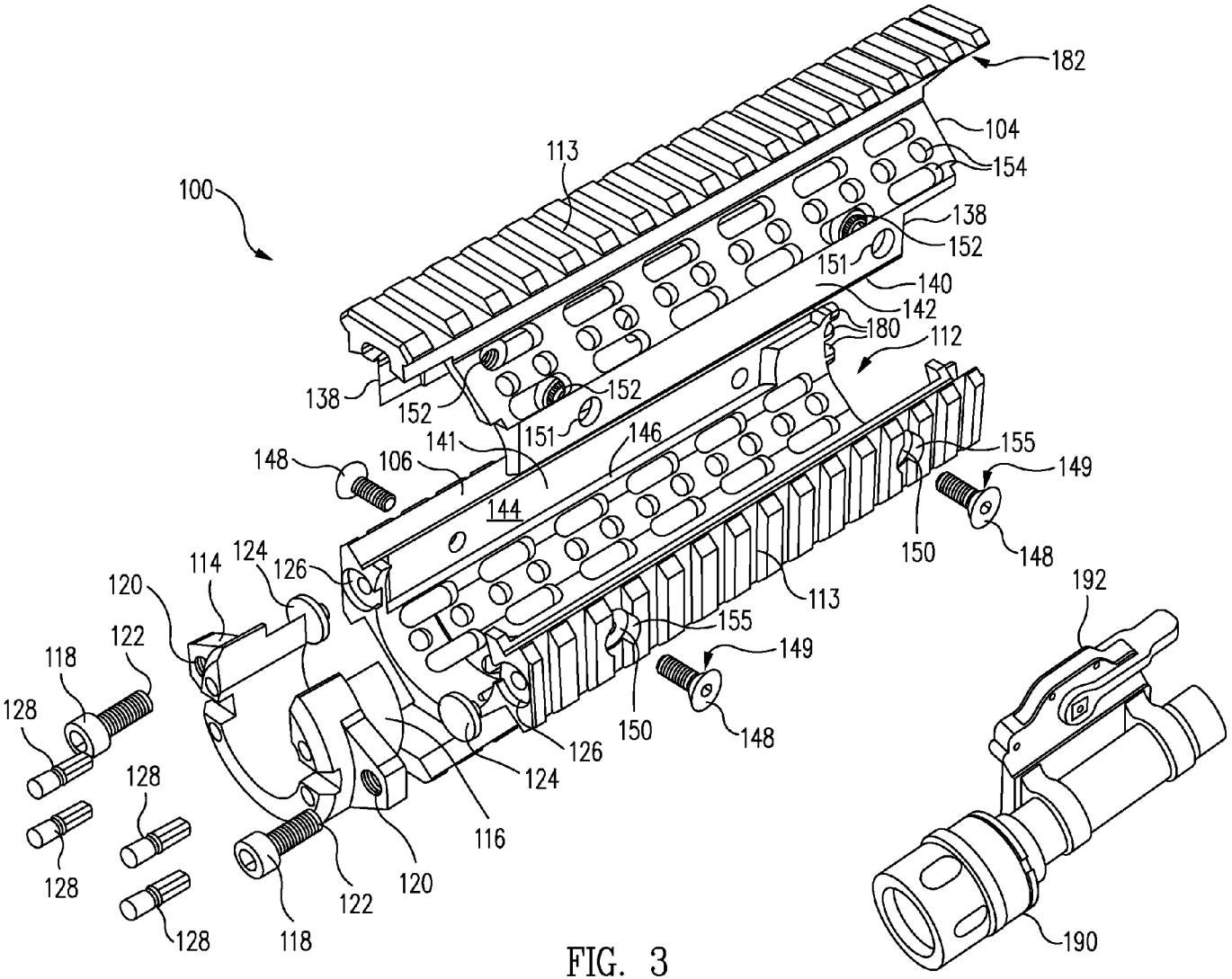
FIG. 3 is an upper, front, left side exploded perspective view of the first example hand guard, showing an upper part, a lower part, and an expansion collar thereof.
Figure 4A:
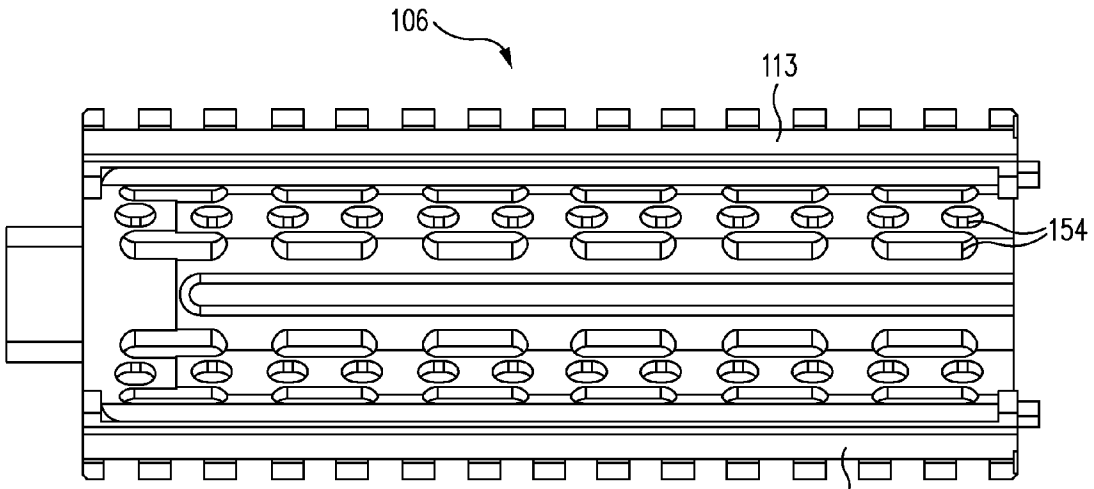
FIG. 4A is top plan view of the lower part of the first example hand guard.
Figure 4B:
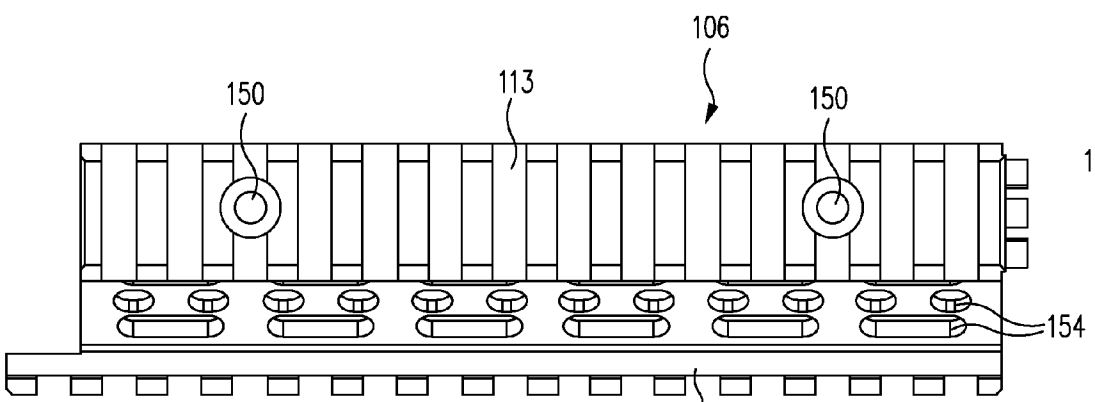
FIG. 4B is a left side elevation view of the lower part.
Figure 4C:
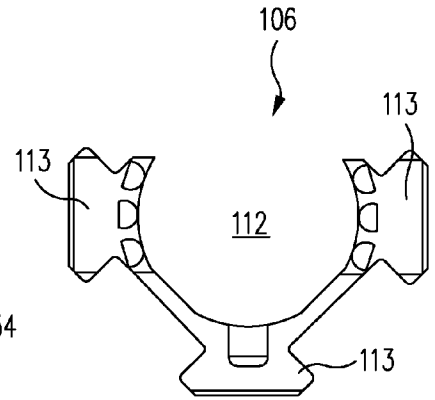
FIG. 4C is a rear end elevation view of the lower part.
Figure 4E:
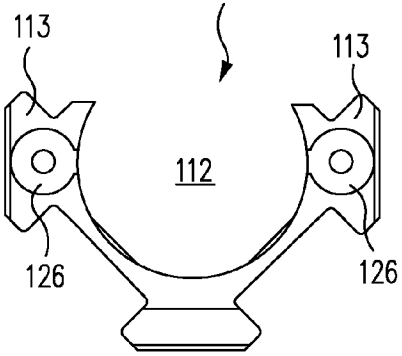
FIG. 4E is a front end elevation view of the lower part.
Figure 4D:
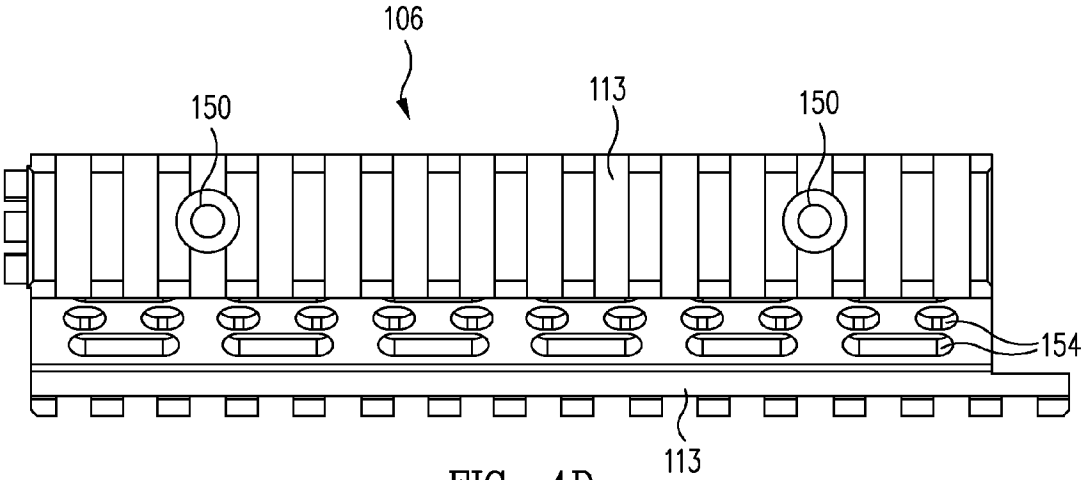
FIG. 4D is a right side elevation view of the lower part.
Figure 4F:
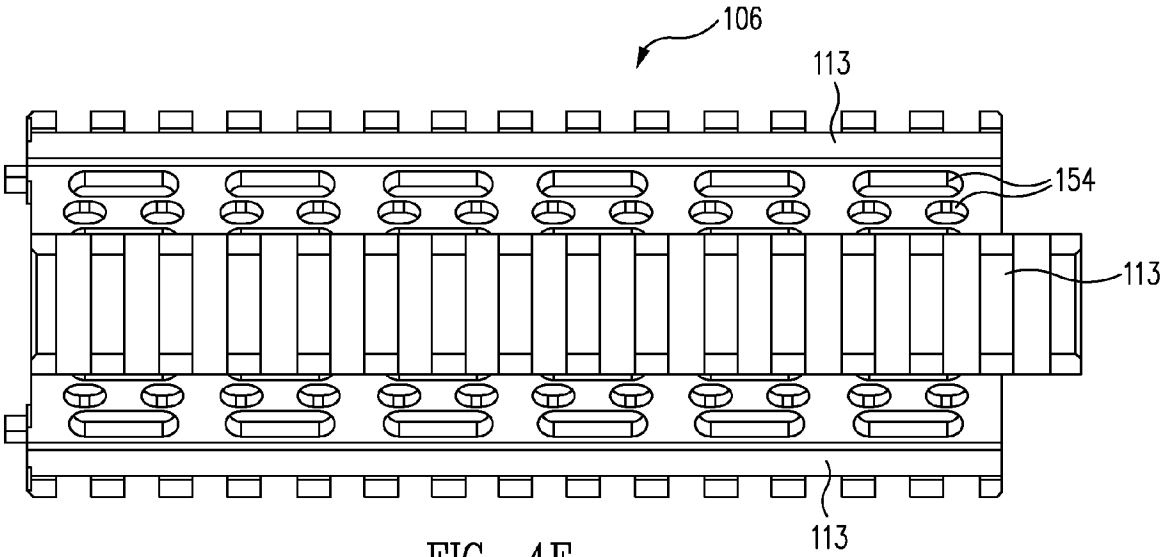
FIG. 4F is a bottom plan view of the lower part.

FIG. 1B is an upper, front, left side perspective view of the receiver 12 and barrel 24 of the rifle 10 of FIG. 1A, showing a first example embodiment of a hand guard 100 in accordance with the present disclosure mounted thereon. FIGS. 2 and 3 are upper, front, left side perspective and exploded perspective views of the example hand guard 100, respectively. As illustrated in FIGS. 2 and 3, the example hand guard 100 comprises an elongated tubular housing 102 having an upper part 104, a lower part 106, opposite open ends 108 and 110, and a lumen 112 configured to receive the gas tube 30 and intermediate portion 32 of the barrel 24 of the firearm 10 longitudinally therein.

Figure 6:
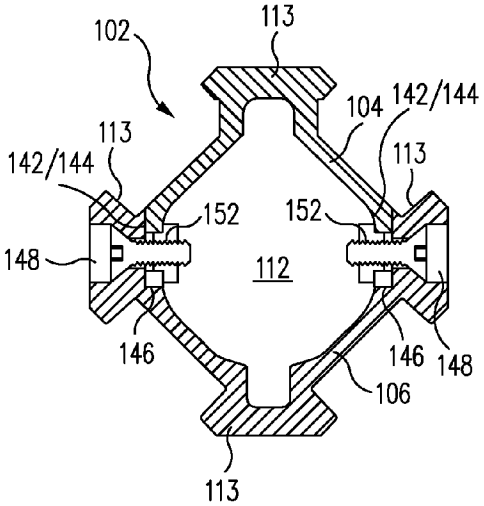
FIG. 6 is a cross-sectional view through the first example hand guard, as seen along the lines of the section 6-6 taken in FIG. 2.
Figure 5D:
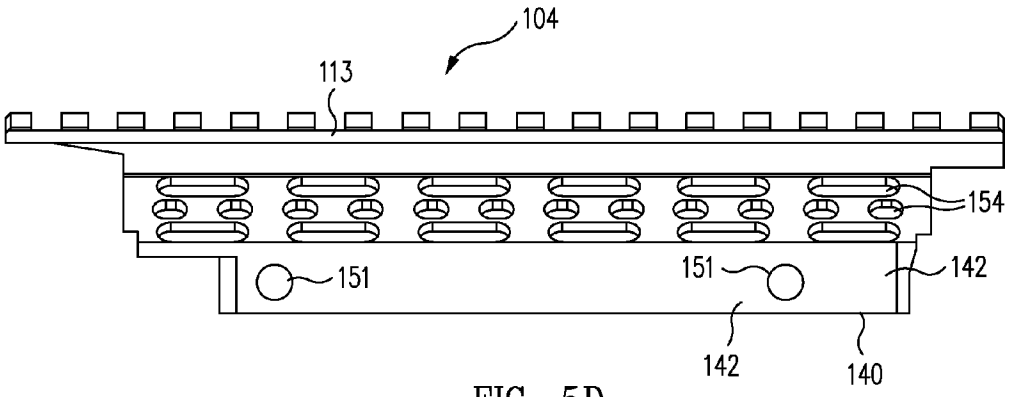
FIG. 5D is a right side elevation view of the upper part.
Figure 5F:
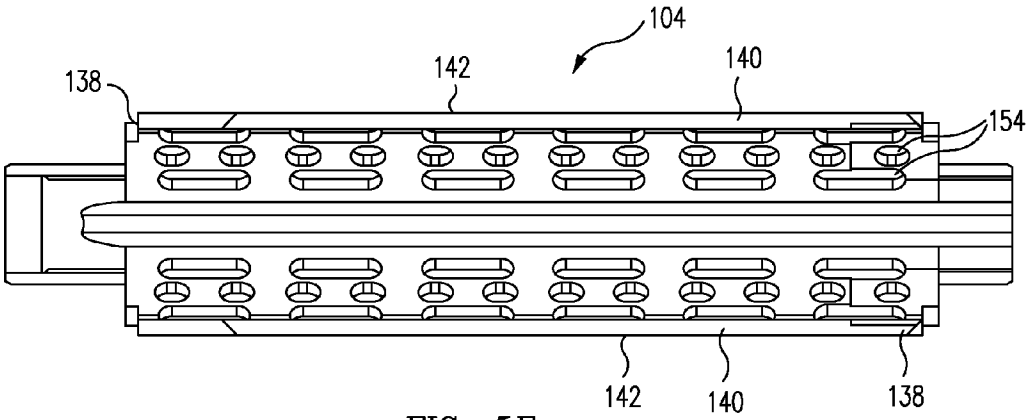
FIG. 5F is a lower plan view of the upper part.

As illustrated in the cross-sectional view of the housing 102 in FIG. 6, the housing 102 can have a generally polygonal cross-section, and in the particular embodiment illustrated, the housing 102 has eight side walls, i.e., is octagonal in cross-sectional shape. Other cross-sectional shapes, including round or annular, can also be used. At least one of the side walls of the housing 102 can comprise a longitudinal accessory mounting rail 113, such as specified in MIL-STD-1913 and commonly referred to as a "Picatinny" rail, or other type of rail. In the particular example embodiment illustrated in FIG. 6, four such accessory mounting rails 113 are provided, disposed in alternating fashion around the circumfery of the housing 102, one comprising the top side wall of the upper part 104 of the housing 102, and three comprising the two lateral and one bottom side walls of the lower part 106 thereof.

As shown in FIG. 1B, when hand guard 100 is installed on receiver 12, a top rail 113 on upper part 104 may be substantially level with another rail 170 (e.g., another longitudinal accessory mounting rail such as another Picatinny rail or other type of rail). Such positioning of rails 113 and 170 may advantageously permit various accessories to be mounted substantially in line with each other on rails 113 and 170 and/or permit such accessories to be mounted across both rails 113 and 170 (e.g., using mounting locations of both rails 113 and 170).

One or more accessories many be mounted on rails 113 such as, for example, lighting devices, sighting devices, and/or others. For example, as identified in FIG. 3, a lighting device 190 (e.g., a SureFire Scout Light in one embodiment) may be provided to be mounted on rails 113 (e.g., directly and/or with a rail clamp 192, such as a SureFire M93 Swing-Lever WeaponLight Rail Clamp in one embodiment and/or as identified in U.S. Pat. No. 8,127,484 which is hereby incorporated by reference in its entirety).

In some embodiments, upper part 104 may include one or more protrusions 182 (e.g., one or more flanges or individual protruding members) configured to engage or contact receiver 12 (see FIGS. 1B and 3). For example, protrusion 182 may extend over, rest upon, and/or push against various external portions of retainer 40 and/or of rear sight 14. In some embodiments, lower part 106 may include one or more protrusions 180 (e.g., implemented as one or more flanges or individual protruding members) configured to engage or contact receiver 12 (see FIGS. 1B and 3). For example, protrusions 180 may rest upon and/or push against retainer 40. In various embodiments, protrusions 180 and/or flanged portion 182 may be used to further secure hand guard 100 to rifle 10.

As illustrated in FIGS. 2, 3, 8, and 9, the example hand guard 100 further comprises an expansion collar 114 disposed at one end of the housing 102. The expansion collar 114 incorporates an expansion mechanism, described below, configured to adjustably compress the expansion collar 114 and the lower part 106 of the housing 102 longitudinally between the radial surfaces 34 and 36 located at opposite ends of the intermediate portion 32 of the barrel 24, as described above. In the particular embodiment illustrated in the figures, the expansion collar 114 is shown disposed adjacent to the front end 108 of the housing 102, but as those of some skill in the art will appreciate, this arrangement can be reversed, such that the expansion collar 114 is disposed adjacent to the rear end 110 of the housing 102.

Additionally, as illustrated in, e.g., FIGS. 2, 3, 7A, 7C, and 7D, the expansion collar 114 can include a longitudinal tongue 116 that can be slid into a complementary recess in the adjacent open ends 108 or 110 of the housing 102 to generally align the collar 114 concentrically with the housing 102 and the lumen 112 thereof.

Figure 8:
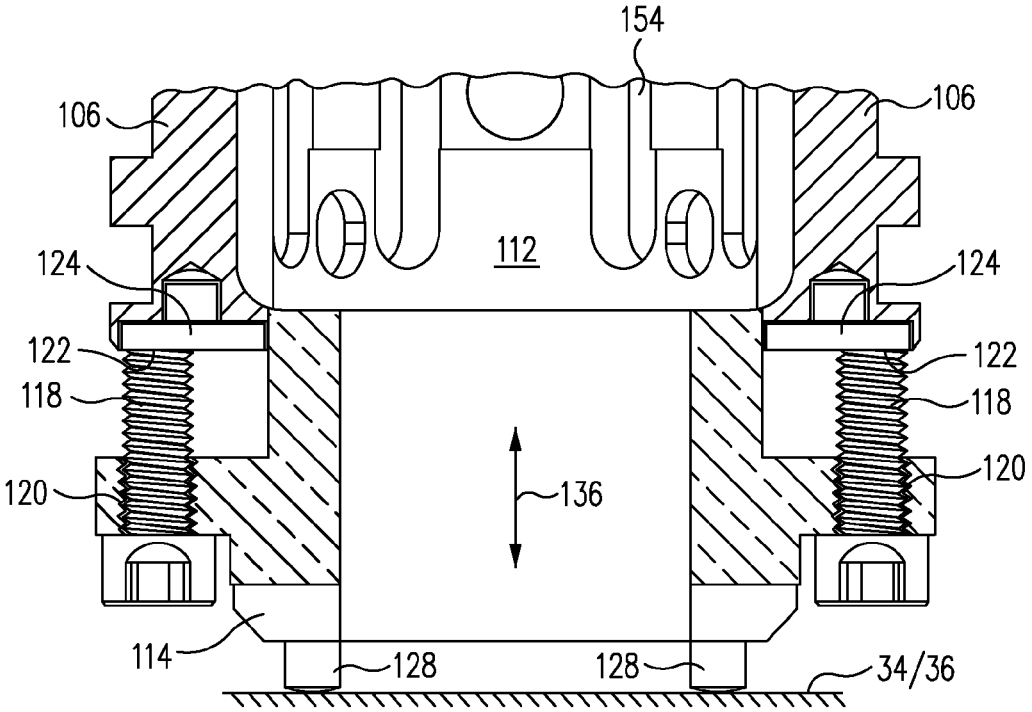
FIG. 8 is a partial cross-sectional view through the expansion collar, screws, and a front end of the first example hand guard, as seen along the lines of the section 8-8 taken in FIG. 2.

As illustrated in, e.g., FIGS. 2, 3 and 8, in one embodiment, the expansion mechanism can comprise a plurality, e.g., two or more, of longitudinally extending screws 118 (e.g., also referred to as jack screws) respectively received in corresponding ones of a plurality of threaded apertures 120 contained in the expansion collar 114. Each screw 118 has a distal end 122 that can be urged into abutment with an adjacent end, 108 or 110 of the lower part 106 of the housing 102. In some embodiments, the end 108 or 110 of the housing 102, against which the distal ends 122 of the screws 118 bear, can be protected against any resultant deformation and wear caused by abutment of the screw ends 122 by the provision of a corresponding plurality of wear pads 124 made of, e.g., a hard metal, disposed in corresponding, complementary recesses 126 in the adjacent end of the lower part 106 of the housing 102. The distal ends 112 of the screws 118 can then respectively bear on the pads 124 with virtually no resulting wear or deformation of the adjacent end of the lower part 106 of the housing. In addition, as screws 118 are tightened, the longitudinal expansion of hand guard 100 may cause protrusions 180 to push against retainer 40 and thus tighten end 110 of hand guard 100 against rifle 10.

Figure 7A:
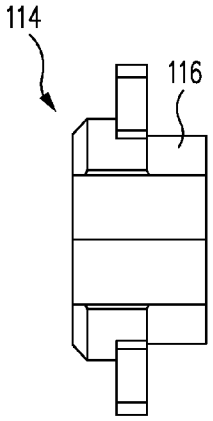
FIG. 7A is a top plan view of the expansion collar part of the first example hand guard.
Figure 7B:
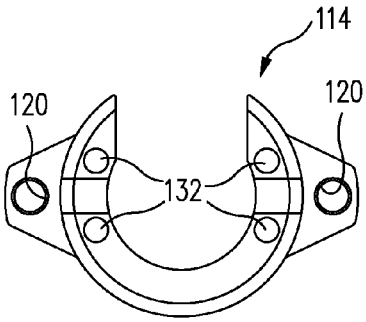
FIG. 7B is a front end elevation view of the expansion collar.
Figure 7C:
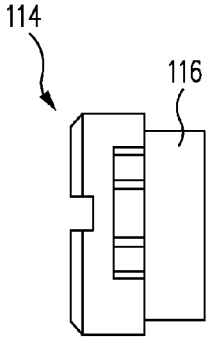
FIG. 7C is a left side elevation view of the expansion collar.
Figure 7D:
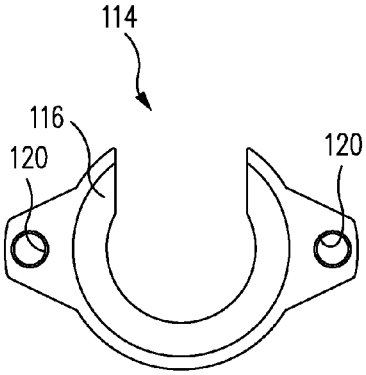
FIG. 7D is a rear end elevation view of the expansion collar.
Figure 7E:
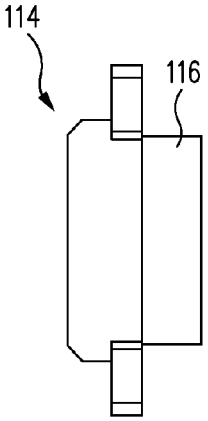
FIG. 7E is a bottom plan view of the expansion collar.
Figure 9:
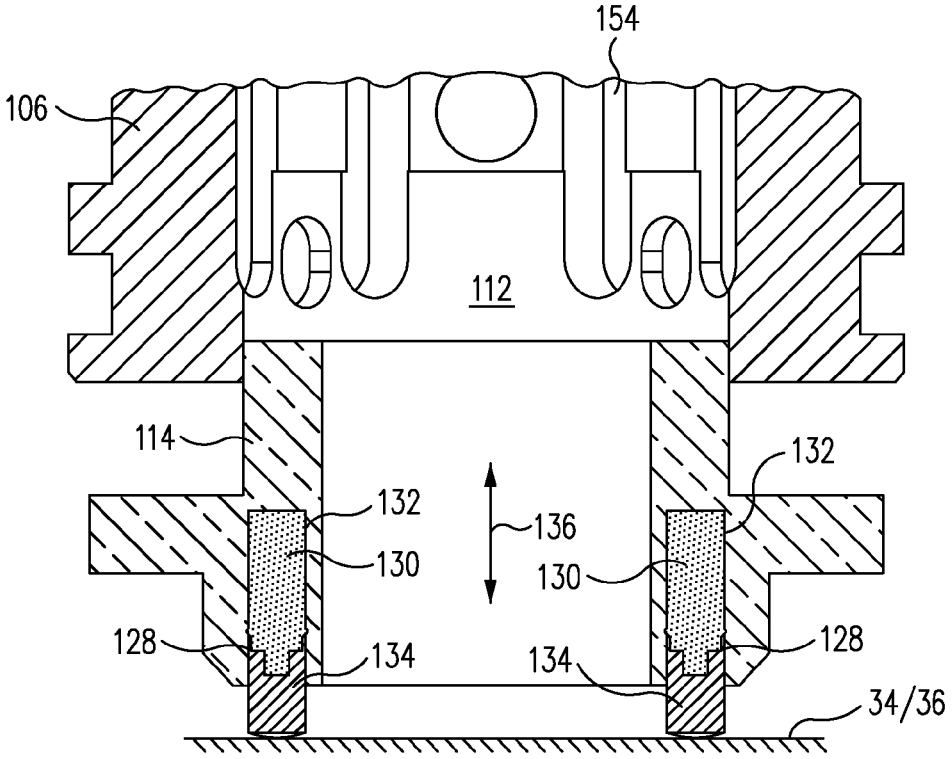
FIG. 9 is a partial cross-sectional view through the expansion collar, compression members, and a front end of the first example hand guard, as seen along the lines of the section 9-9 taken in FIG. 2.

As illustrated in, e.g., FIGS. 3 and 9, in some embodiments, the expansion mechanism can further include a plurality of elongated compression members 128 that extend longitudinally from an end of the expansion collar 114 opposite to the end of the housing 102 at which the expansion collar 114 is disposed. As illustrated in FIG. 9, the compression members 128 can include a first end portion 130 that can comprise a material that may compress and expand (e.g., being at least partially deformable, compressible, and/or expandable) while still remaining relatively resilient, such as rubber or polyurethane, which is disposed in a corresponding bore 132 (see FIG. 7B) in the expansion collar 114, and an opposite second end 134 comprising a relatively harder bearing material, e.g., a metal, such as steel.

In some embodiments, the example hand guard 100 can be mounted on an associated rifle 10 in accordance with the following example mounting method, in which it is assumed that the expansion collar 114 is mounted at the front end 108 of the housing 102 and disposed adjacent to the front radial surface 34, as illustrated in the example embodiment of FIGS. 1A and 1B.

First, the upper part of the housing 102 is removed from the lower part 106, which can be effected in a manner described in more detail below. The longitudinal tongue 116 of the expansion collar 114 is inserted into the front end 108 of the lower part 106 of the housing 102 to form a loose assembly therewith. The assembly of the expansion collar 114 and lower part 106 of the housing 102 is then mounted onto the lower surface of the intermediate portion 32 of the rifle barrel 24 and between the radial surfaces 34 and 36 disposed at the opposite ends thereof, i.e., with the compression members 128 of the expansion collar 114 disposed adjacent to the front radial surface 34 and the rear end 110 of the lower part 106 of the housing 102 disposed adjacent to the rear radial surface 36. In one embodiment, the assembly of the expansion collar 114 and lower part 106 of the housing may be positioned around (e.g., without touching) the intermediate portion 32 of the rifle barrel 24 and rotated thereabout until the lower part 106 of the housing 102 is disposed beneath the rifle barrel 24.

As illustrated in FIG. 8, the screws 118 are then advanced in their respective threaded apertures 120 in the expansion collar 114 such that the distal end 122 of each screw 118 engages a corresponding pad 124 in the adjacent end of the lower part 106 of the housing 102. As indicated by the arrows 136 in FIGS. 8 and 9, further advancement of the screws 118 causes the lower part 102 and expansion collar 114 to spread apart from each other, thereby loading the entire longitudinal assembly comprising the compression members 128, the expansion collar 114, and the lower part 106 of the housing 102, in compression between the two radial surfaces 34 and 36, thereby firmly coupling the longitudinal assembly firmly to the rifle 10.

As those of some skill will appreciate, this compressive force results in a reactive longitudinal tensile force being applied to the barrel 24 of the rifle 10, which, unlike various prior hand guards, does not result in any twisting or local deformations of the barrel 24, and therefore does not adversely affect the accuracy of the rifle 10. Any differences in the respective forces exerted by the screws 118 are taken up by the plurality of compression members 128, which compress or expand locally (e.g., performed by the material of first end portion 130) to ensure that the force exerted by the screws 118 is substantially uniformly distributed among the compression members and on the adjacent end of the lower part 106 of the housing 102. although such compression and expansion is described as being performed by the material of first end portion 130 of compression members 128, such material may be provided by any component of hand guard 100. For example, in one embodiment, such material may be provided as part of screws 118 and/or other components adapted to compress and expand between end 108 and surface 34.

One of the many advantages provided by embodiments of the first example hand guard 100 of the present disclosure is that the upper part 104 of the housing 102 can be removed from the lower part 106 of the housing 102, e.g., to gain access to the gas tube 30 and/or the intermediate portion 32 of the barrel 24, without having to remove the lower part 106 and expansion collar 114 from the rifle 10. As illustrated in, e.g., FIGS. 3 and 6, this can be effected by the provision of a coupling mechanism for releasably coupling the upper part 104 of the housing 102 to the lower part 106 thereof. Moreover, the lower part 106 may remain tightly engaged with surfaces 34 and 36 (e.g., by longitudinal expansion) while the upper part 104 is removed. As a result, accessories installed onto lower part 106 may remain attached and in alignment while the upper part 104 is removed. Also, accessories installed onto upper part 104 may also remain attached and in alignment while the upper part 104 is removed. Therefore, if upper part 104 is subsequently attached to lower part 106, all accessories attached to hand guard 100 may be aligned and ready for use without requiring further adjustment by the user.

In other embodiments, the locations and/or configurations of upper part 104 and/or lower part 106 may be changed. For example, in one embodiment, the locations of upper part 104 and lower part 106 may be reversed such that upper part 104 is actually positioned below lower part 106 while hand guard 100 is installed on intermediate portion 32 of barrel 24. In such an embodiment, upper part 104 may be lowered downward from rifle 10 (e.g., lowered down on the trigger side of rifle 10) while lower part 106 remains installed (e.g., positioned on a top side of rifle 10 and straddling intermediate portion 32 of barrel 24).

Figure 5A:
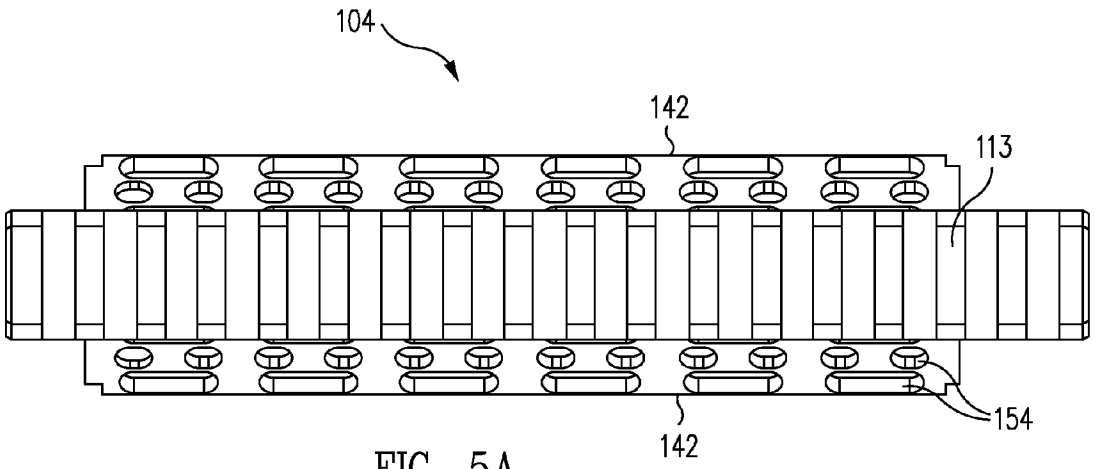
FIG. 5A is a top plan view of the upper part of the first example hand guard.
Figure 5B:
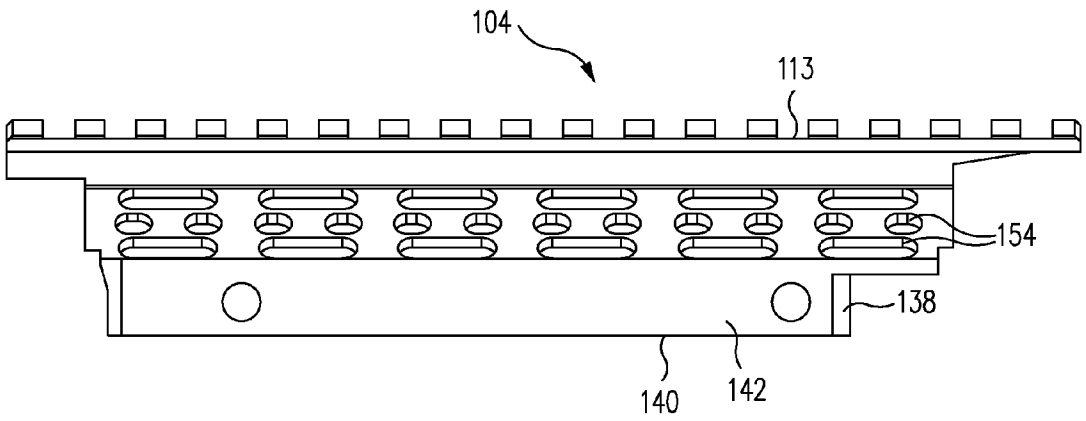
FIG. 5B is a left side elevation view of the upper part.
Figure 5C:
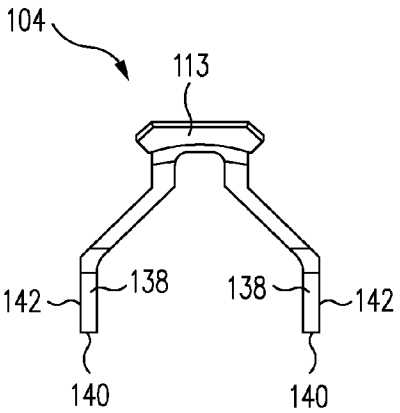
FIG. 5C is a rear end elevation view of the upper part.
Figure 5E:
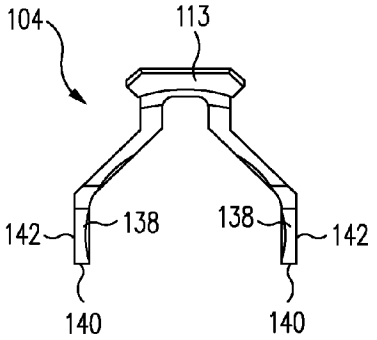
FIG. 5E is a front end elevation view of the upper part.

As illustrated in, e.g., FIGS. 3, 5C, and 5E, the upper part 104 of the housing 102 can include a pair of laterally spaced, downwardly extending side walls 138, each having a lower edge 140 and a generally planar exterior surface 142. As illustrated in, e.g., FIGS. 3 and 6, the lower part 106 of the housing 102 can have a pair of laterally spaced, upwardly extending side walls 141, each of which has a generally planar interior surface 144, with a ledge 146 disposed at a lower edge thereof. As illustrated in FIG. 6, the side walls 138 of the upper part 104 are positionable inside the side walls 141 of the lower part 106 such that respective ones of the planar exterior surfaces 142 of the side walls 138 of the upper part 104 are disposed in facing opposition to corresponding ones of the planar interior surfaces 144 of the side walls 141 of the lower part 102. As illustrated in, e.g., FIGS. 3, 4B, 4D and 6, the coupling mechanism can comprise a plurality of threaded fasteners 148 respectively extending laterally through apertures 150 (e.g., openings) in corresponding ones of the side walls 141 of the lower part 106 of the housing 102 and into corresponding threaded apertures 152 disposed in corresponding ones of the side walls 138 of the upper part 104 of the housing 102, and arranged such that advancement of the fasteners 148 into the threaded apertures 152 acts to pull the planar surfaces 142 of the side walls 138 of the upper part 104 into engagement with corresponding ones of the planar surfaces 144 of the side walls 141 of the lower part 106. In one embodiment, threaded apertures 152 may be provided by side walls 138 of the upper part 104 (e.g., integral therewith). In another embodiment, threaded apertures 152 may be provided by separate components (e.g., nuts or bushings) that are pressed, welded, and/or otherwise attached positioned into apertures 151 of the upper part 104 (e.g., positioned within lumen 112 when hand guard 100 is assembled).

Additionally, in some embodiments, the threaded apertures 152 in the side walls 138 of the upper part 104 can be respectively disposed a first distance above the lower edge 140 of the corresponding side wall 138 of the upper part 104, and the apertures 150 in the side walls 141 of the lower part 106 can be respectively disposed a second distance above the ledge 146 of the corresponding side wall 141. The first distance can be made slightly greater than the second distance (e.g., greater by a distance of approximately 8 thousandths of an inch in one embodiment), such that advancement of the threaded fasteners 148 into the threaded apertures 152 further acts to pull the lower edges 140 of the side walls 138 of the upper part 104 into a tight engagement with the corresponding ledges 146 of the side walls 141 of the lower part 106, thus ensuring a tight coupling of the upper part 104 to the lower part 106.

In some embodiments, as shown in FIG. 3, apertures 150 may be implemented with countersinks 155. In one embodiment, countersinks 155 may be offset downward or otherwise (e.g., by approximately 8 thousandths of an inch in one embodiment) such that upper portions of heads 149 of threaded fasteners 148 contact rail 113 and/or the lower part 106 before threaded fasteners 148 are fully screwed into threaded apertures 152 and fully seated within countersinks 155. Such contact can provide compressive force to further secure upper part 104 and lower part 106 together.

As illustrated in, e.g., FIGS. 2 and 3, selected ones or all of the side walls of the housing 102 can include a pattern of vent holes 154 extending therethrough. The vent holes 154 serve to reduce the weight of the hand guard substantially, and can also serve both to cool the barrel 24 of the rifle 10 during extended firing thereof, thereby ensuring that the hand guard 100 remains cool to the touch, and also to mount certain types of accessories to the hand guard 100 (e.g., such as lighting device 190 in one embodiment). In various embodiments, accessories may be mounted directly to vent holes 154 (e.g., without requiring rail clamp 192 or other mounting mechanisms).

Figure 10:
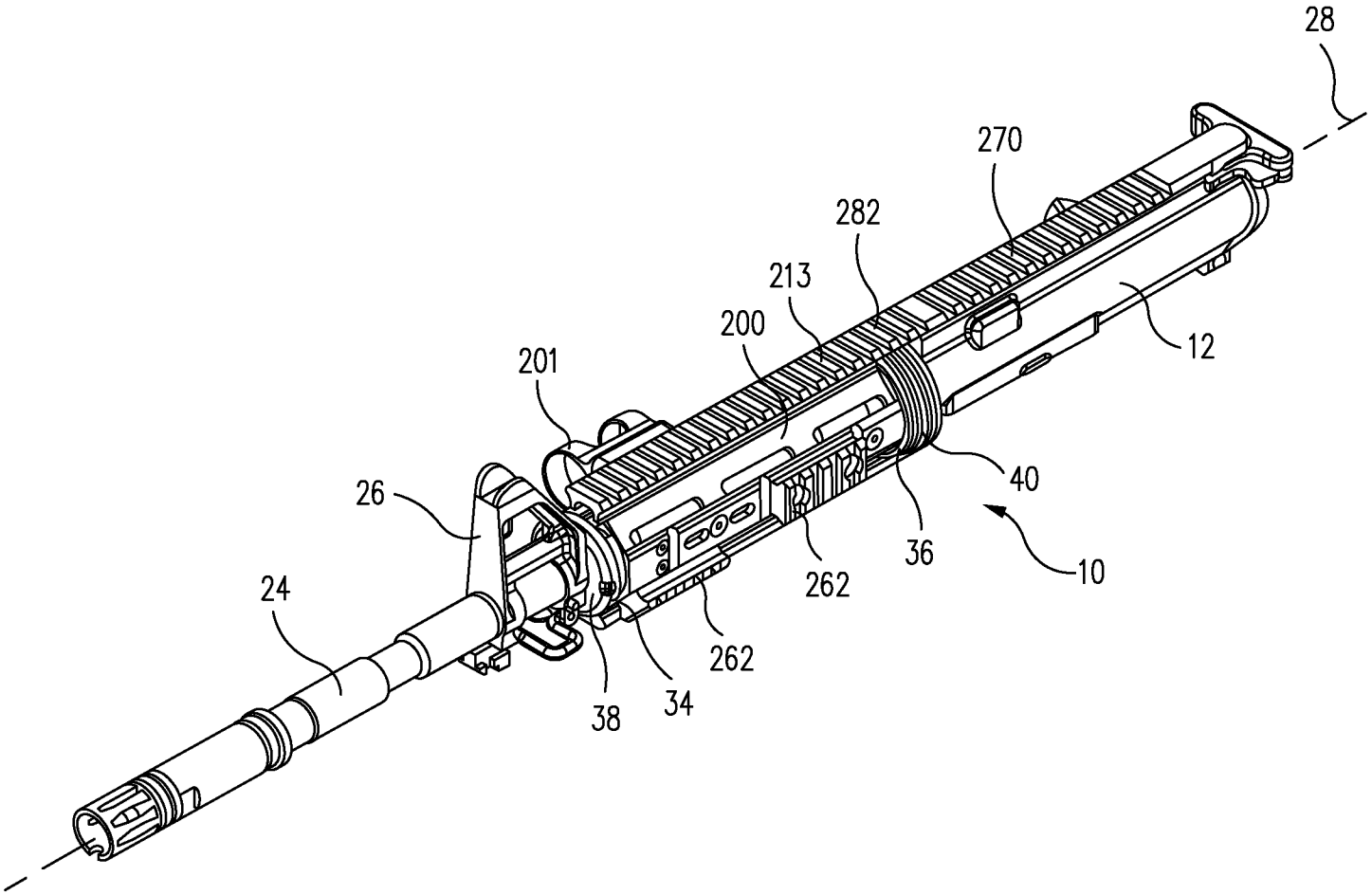
FIG. 10 is an upper left side perspective view of a receiver and barrel of an M4 rifle, showing a second example embodiment of a hand guard in accordance with the present disclosure mounted thereon.
Figure 11:
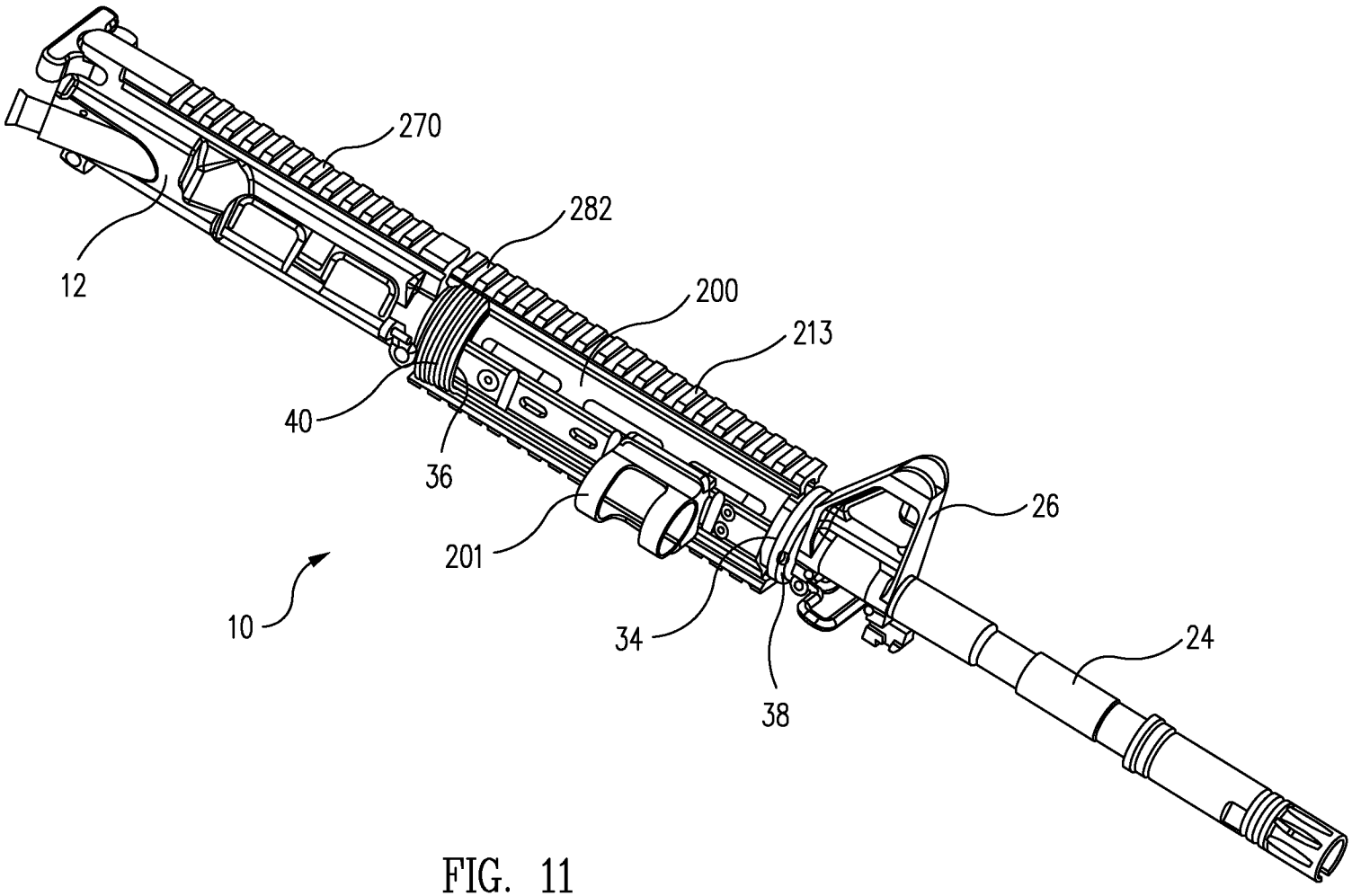
FIG. 11 is an upper, front, right side perspective view of the receiver, barrel and second example hand guard of FIG. 10, showing an example accessory mounting bracket mounted thereon.

FIG. 10 is an upper left side perspective view of a receiver and barrel of an M4 rifle 10 (e.g., with rear sight 14 removed), showing a second example embodiment of a hand guard 200 in accordance with the present disclosure mounted thereon, and FIG. 11 is an upper, front, right side perspective view of the receiver, barrel and second example hand guard 200 of FIG. 10, showing an example accessory mounting bracket 201 mounted on the right side thereof.

As can be seen from a comparison of the figures respectively illustrating the first and second example hand guards 100 and 200, the two example hand guards 100 and 200 differ in various ways such as, for example, the mechanisms used to spread the lower part of the hand guard and expansion collar apart from each other so as load the assembly of the expansion collar and the lower part of the housing of the hand guard in compression between the two radial surfaces 34 and 36 of the rifle 10, coupling mechanisms and engagement surfaces, features in the side walls of the hand guard housing that enable various accessory mounting brackets to be coupled to it efficiently and reliably, and other features further discussed herein.

Figure 12:
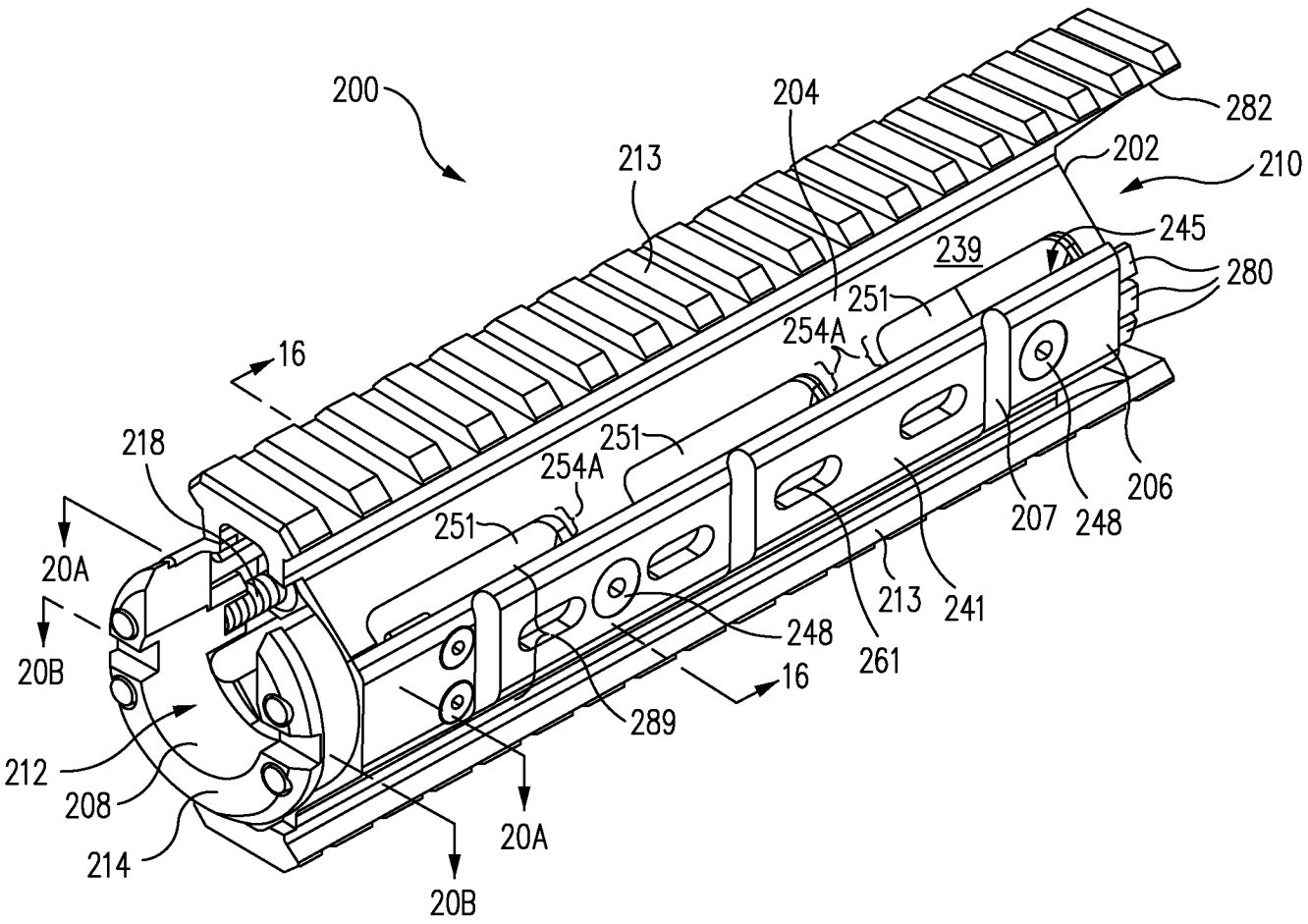
FIG. 12 is an upper, front, left side perspective view of the second example hand guard of FIGS. 10 and 11.
Figure 13:
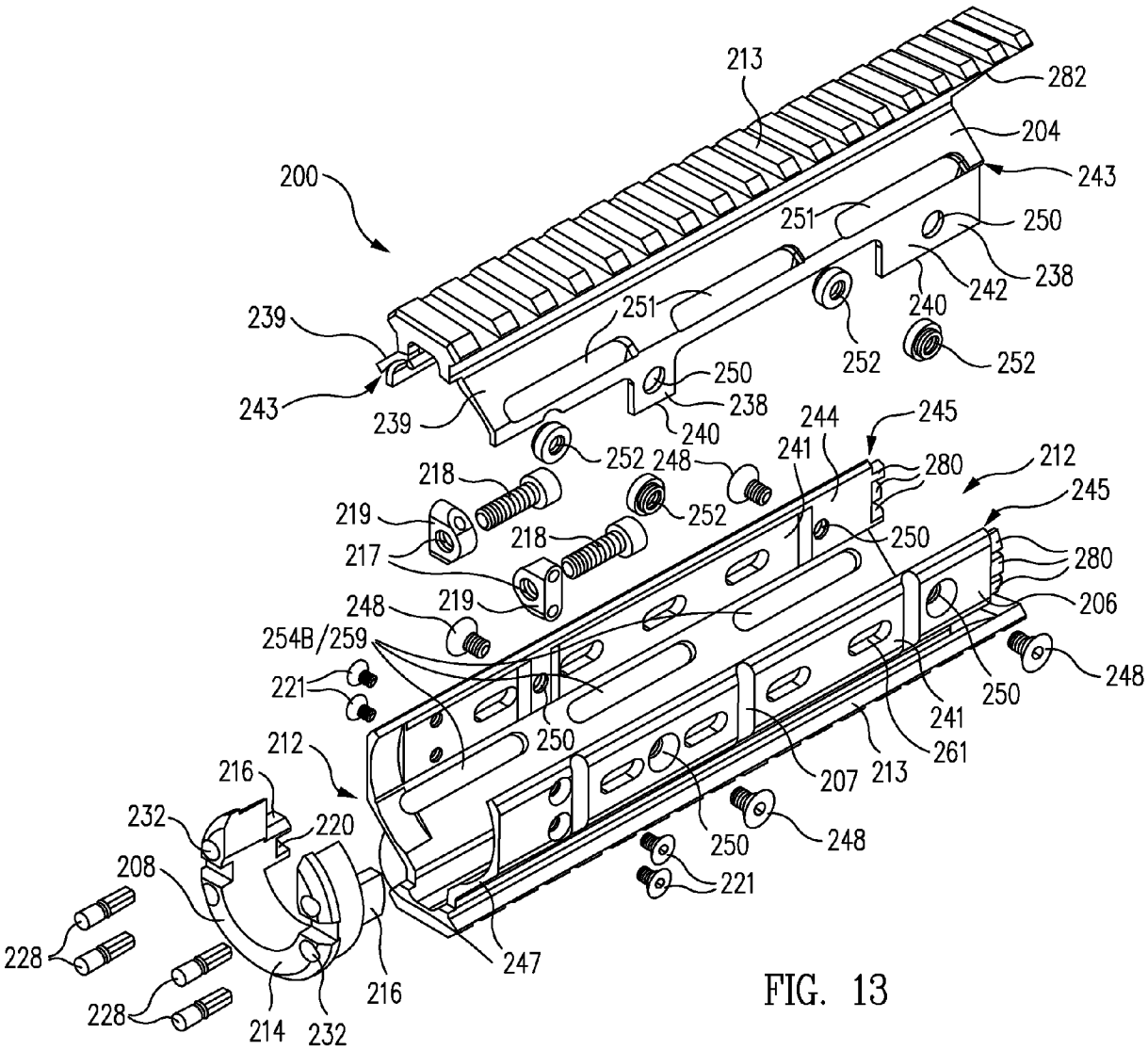
FIG. 13 is an upper, front, left side exploded perspective view of the second example hand guard, showing an upper part, a lower part, and an expansion collar thereof.

FIGS. 12 and 13 are upper, front, left side perspective and exploded perspective views of the second example hand guard 200, respectively. As illustrated in FIGS. 12 and 13, the second example hand guard 200 can, like the first example embodiment 100 above, comprise an elongated tubular housing 202 having an upper part 204, a lower part 206, opposite open ends 208 and 210, and a longitudinal lumen 212 configured to accommodate the gas tube 30 and intermediate portion 32 of the barrel 24 of the rifle 10 longitudinally therein.

As illustrated in the cross-sectional view of the housing 202 in FIGS. 16 and 19A-19C, the housing 202 can have a generally polygonal cross-section, and in the particular embodiment illustrated, the housing 202 has eight side walls, i.e., has a cross-sectional shape that is octagonal. Of course, other cross-sectional shapes, including round or annular, can also be used. At least one of the side walls of the housing 202 can comprise an integrally formed, longitudinal accessory mounting rail 213, such as specified in MIL-STD-1913 and commonly referred to as a "Picatinny" rail, or as discussed below, a variation thereof. In the particular example embodiment illustrated in FIGS. 16 and 19A-19C, two such integral accessory mounting rails 213 are provided, i.e., one disposed atop the top wall of the upper part 204 of the housing 202, and one disposed on the bottom wall of the lower part 206 thereof.

As illustrated in FIGS. 10 and 11, when the second example hand guard 200 is installed on the receiver 12 of the rifle 10, a top rail 213 on the upper part 204 can be disposed substantially level with another rail 270 (e.g., another longitudinal accessory mounting rail, such as another Picatinny rail or other type of rail). Such positioning of the rails 213 and 270 can advantageously enable various accessories to be mounted substantially in line with each other on the rails 213 and 270 and/or enable such accessories to be mounted across both rails 213 and 270 (e.g., using the mounting locations of both rails 213 and 270). As discussed above in connection with the first example embodiment 100, one or more accessories can be mounted on the rails 213 such as, for example, lighting devices, sighting devices, and/or other types of devices.

In some embodiments, the upper part 204 can include one or more protrusions 282 (e.g., one or more flanges or individual protruding members) configured to engage or overlie a front end portion of the receiver 12 (see, e.g., FIGS. 10-12). For example, the protrusion 282 can extend over, rest upon, and/or push against various external portions of the retainer 40. In some embodiments, the lower part 206 can include one or more protrusions 280 (e.g., implemented as one or more flanges or individual protruding fingers) configured to engage or contact the retainer (e.g., barrel nut) 40 (see, e.g., FIGS. 12 and 13). For example, the protrusions 280 can rest upon and/or push against the retainer 40. In various embodiments, the protrusions 280 and/or the flanged portion 282 can be used to further secure the hand guard 200 to the rifle 10.

As illustrated in, e.g., FIGS. 12, 13, 17A-17E, 20A and 20B, the second example hand guard 200 also comprises an expansion collar 214 disposed at one end of the housing 202. The expansion collar 214 incorporates an expansion mechanism, described in more detail below, that is configured to adjustably compress the expansion collar 214 and the lower part 206 of the housing 202 longitudinally between the radial surfaces 34 and 36 located at opposite ends of the intermediate portion 32 of the barrel 24, as described above. In the particular embodiment illustrated in the figures, the expansion collar 214 is shown disposed adjacent to the front end 208 of the housing 202, but as those of some skill in this art will appreciate, this arrangement can be reversed, such that the expansion collar 214 is disposed adjacent to the rear end 210 of the housing 202.

Additionally, as illustrated in, e.g., FIGS. 13 and 17A-17E, the expansion collar 214 can include a pair of longitudinal tongues 216 that can be slid into a complementary recess in the adjacent open ends 208 or 210 of the housing 202 to generally align the collar 214 concentrically with the housing 202 and the lumen 212 thereof.

Figure 20A:
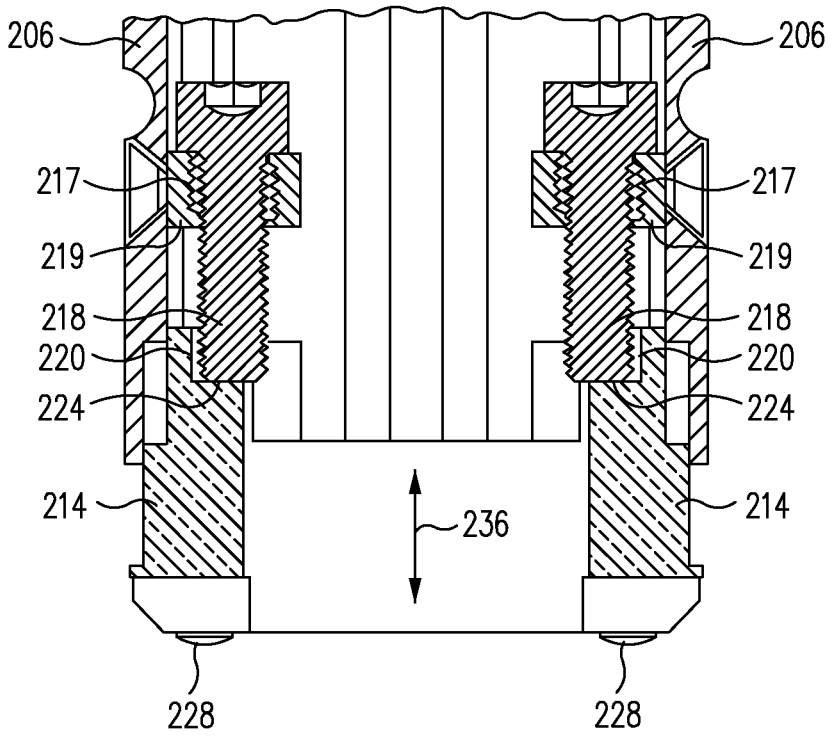
FIG. 20A is a partial cross-sectional view through the expansion collar, jack screws, and a front end of the second example hand guard, as seen along the lines of the section 20A-20A taken in FIG. 12.

As illustrated in, e.g., FIGS. 13 and 20A, in one embodiment, the expansion mechanism can comprise a pair of longitudinally extending screws 218 (also referred to herein as jack screws) respectively received in corresponding ones of a pair of threaded apertures 217 respectively contained in a corresponding pair of laterally opposing stanchions 219 respectively attached to the inner surfaces of the side walls 241 of the lower part 206. In the particular example embodiment illustrated in the figures, each of the two side wall stanchions 219 is attached to a corresponding side wall 241 of the lower part 206 by a pair of threaded fasteners 221 that extend through corresponding through-apertures in the adjacent side wall 241 and into corresponding threaded apertures in the stanchions 219. However, as those of some skill will understand, the stanchions 219 can be coupled or connected to the side walls 241 of the lower part 206 using other methods, such as brazing, welding, staking, riveting, adhesive bonding and so on.

Figure 17A:
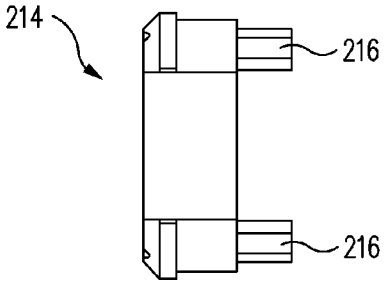
FIG. 17A is a top plan view of the expansion collar of the second example hand guard.
Figure 17B:
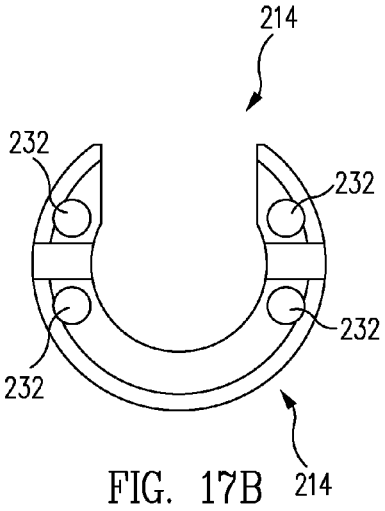
FIG. 17B is a front end elevation view of the expansion collar.
Figure 17C:
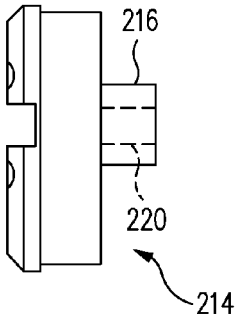
FIG. 17C is a left side elevation view of the expansion collar.
Figure 17D:
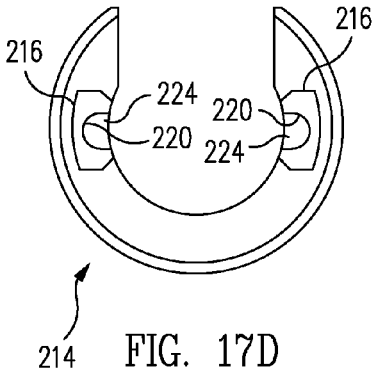
FIG. 17D is a rear end elevation view of the expansion collar.
Figure 17E:
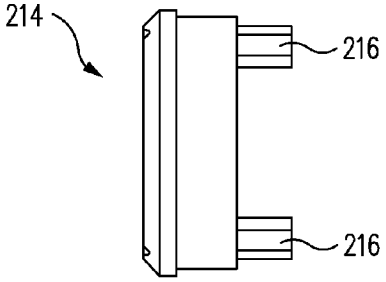
FIG. 17E is a bottom plan view of the expansion collar.

As illustrated in FIGS. 17D and 20A, each of the longitudinal tongues 216 of the expansion collar 214 includes a longitudinal bore 220 having an open side and a bottom end surface 224. Each jack screw 218 has a distal end that can be urged into abutment with an corresponding one of the bottom end surfaces 224 of the longitudinal bores 220 by advancing the jack screw 218 in the threaded aperture 217 of the corresponding stanchion 219. Thus, as the screws 218 are advanced within the threaded apertures 217 of the stanchions 219 (e.g., in an opposite direction as screws 118 of hand guard 100), the resulting longitudinal expansion of the hand guard 200 causes the protrusions 280 to push against the retainer 40 and thereby tighten the end 210 of the hand guard 200 against the forward facing surface 36 of the receiver 12 of the rifle 10.

Figure 20B:
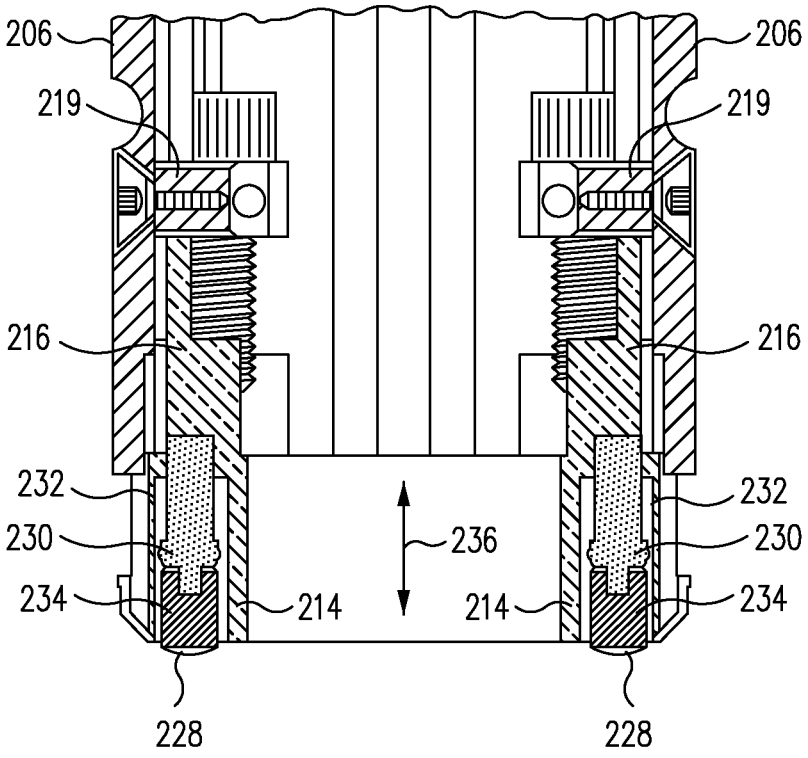
FIG. 20B is a partial cross-sectional view through the expansion collar, compression members, and the front end of the second example hand guard, as seen along the lines of the section 20B-20B taken in FIG. 12.

As illustrated in, e.g., FIGS. 13 and 20B, in some embodiments, the expansion mechanism can further include a plurality of elongated compression members 228 that extend longitudinally from an end of the expansion collar 214 opposite to the end of the housing 202 at which the expansion collar 214 is disposed. As illustrated in FIG. 20B, the compression members 228 can include a first end portion 230 that can comprise a material that can compress and expand (e.g., being at least partially deformable, compressible, and/or expandable) while still remaining relatively resilient, such as a rubber or polyurethane, which is disposed in a corresponding bore 232 (see, e.g., FIG. 17B) in the expansion collar 214, and an opposite second end 234 that can comprise a relatively harder bearing material, e.g., a metal, such as steel or aluminum.

In some embodiments, the second example hand guard 200 can be mounted on an associated rifle 10 in accordance with the following example mounting method, in which it is assumed that the expansion collar 214 is mounted at the front end 208 of the housing 202 and disposed adjacent to the front radial surface 34 of the rifle 10, as illustrated in the example embodiment of FIGS. 10 and 11. However, as discussed above, this orientation can be reversed, if desired.

First, the upper part 204 of the housing 202 is removed from the lower part 206, which can be effected in a manner described in more detail below. The longitudinal tongues 216 of the expansion collar 214 are inserted into the front end 208 of the lower part 206 of the housing 202 to form a loose assembly therewith. The assembly of the expansion collar 214 and lower part 206 of the housing 202 is then mounted onto the lower surface of the intermediate portion 32 of the rifle barrel 24 and between the radial surfaces 34 and 36 disposed at the opposite ends thereof, i.e., with the compression members 228 of the expansion collar 214 disposed adjacent to the rear-facing front surface 34 and the rear end 210 of the lower part 206 of the housing 202 disposed adjacent to the front-facing rear surface 36. In one embodiment, the assembly of the expansion collar 214 and lower part 206 of the housing 202 can be positioned around (e.g., without touching) the intermediate portion 32 of the rifle barrel 24 and rotated thereabout until the lower part 206 of the housing 202 is disposed below the rifle barrel 24.

As illustrated in FIGS. 20A and 20B, the screws 218 are then advanced in their respective threaded apertures 217 in the stanchions 219 such that the distal end of each screw 218 is disposed in abutment with corresponding one of the bottom end surfaces 224 of the longitudinal bores 220 in the tongues 216 of the expansion collar 214. As indicated by the arrows 236 in FIGS. 20A and 20B, further advancement of the screws 218 causes the lower part 206 and the expansion collar 214 to spread apart from each other longitudinally, thereby loading the entire longitudinal assembly comprising the compression members 228, the expansion collar 214, and the lower part 206 of the housing 202, in compression between the two radial surfaces 34 and 36, thereby firmly coupling the longitudinal assembly firmly to the rifle 10.

As those of some skill will appreciate, this compressive force results in a reactive longitudinal tensile force being applied to the barrel 24 of the rifle 10, which, unlike various prior hand guards, does not result in any twisting or local deformations of the rifle barrel 24, and therefore, does not adversely affect the accuracy of the rifle 10. Any differences in the respective forces exerted by the screws 218 are taken up by the plurality of compression members 228, which compress or expand locally (e.g., effected by the resilient material of first end portion 230) to ensure that the force exerted by the screws 218 is substantially uniformly distributed among the compression members 228 and on the adjacent end of the bottom part 206 of the housing 202. Although such compression and expansion is described as being effected by the material of the first end portions 230 of compression members 228, such operation can also be provided by any component of the hand guard 200. For example, in one embodiment, this function may be effected by, for example, a spring comprising a part of the jack screws 218 and/or other components adapted to compress and expand between the end 208 of the lower part 206 of the housing 202 and the rear-facing radial surface 34.

One of the many advantages provided by the embodiments of the hand guard 100 and 200 of the present disclosure is that the upper part 104 or 204 of the housing 102 or 202 can be removed from the lower part 106 or 206 of the housing 102 or 202, e.g., to gain access to the gas tube 30 and/or the intermediate portion 32 of the barrel 24, without having to remove the lower part 106 or 206 and the expansion collar 114 or 214 from the rifle 10. As illustrated in, e.g., FIGS. 13 and 16, this can be effected in the case of the second example hand guard 200 by the provision of a coupling mechanism for releasably coupling the upper part 204 of the housing 202 to the lower part 206 thereof. Moreover, the lower part 206 can remain tightly engaged with surfaces 34 and 36 (e.g., by longitudinal expansion) while the upper part 204 is removed. As a result, accessories installed on the lower part 206 can remain attached and in alignment with the rifle 10 while the upper part 204 is removed. Also, any accessories installed onto the upper part 204 can also remain attached and in alignment with the upper part 204 when the upper part 204 is removed. Thus, if the upper part 204 is subsequently re-attached to the lower part 206, all accessories attached to the hand guard 200, whether mounted on the upper part 204 or the lower part 206 will remain aligned and ready for use without requiring further adjustment by the user.

In other embodiments, the locations and/or configurations of the upper part 204 and/or lower part 206 can be changed. For example, in one embodiment, the locations of the upper part 204 and lower part 206 can be reversed such that upper part 204 is actually positioned below the lower part 206 while hand guard 200 is installed on intermediate portion 32 of barrel 24. In such an embodiment, the upper part 204 can be lowered downward from rifle 10 (e.g., lowered down to the trigger side of rifle 10) while lower part 206 remains installed (e.g., positioned on a top side of the rifle 10 and straddling the intermediate portion 32 of the barrel 24). Indeed, in this embodiment (and applicable to hand guard 100 and 200), it is possible to omit the upper part 104/204 entirely and install, for example, a grenade launcher or other component in its place below the barrel 24 of the rifle 10. In other embodiments, upper part 104/204 may be omitted while lower part 106/206 is positioned on a bottom side of the rifle 10 (e.g., to permit installation of any desired apparatus in place of upper part 104/204 above barrel 24). In any case, omission of upper part 104/204 may also permit the user to gain access to barrel 24, gas tube 30 (e.g., in some embodiments, gas tube 30 may not be accessible while upper part 104/204 is removed), and/or other portions of rifle 10 while lower part 106/206 remains installed in a position on a bottom side or top side of rifle 10.

Figure 14A:
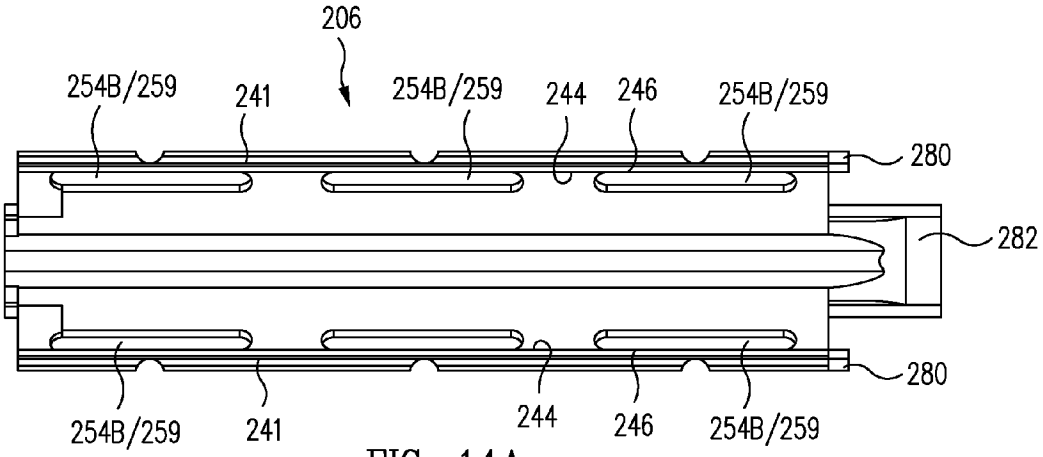
FIG. 14A is top plan view of the lower part of the second example hand guard.
Figure 14B:
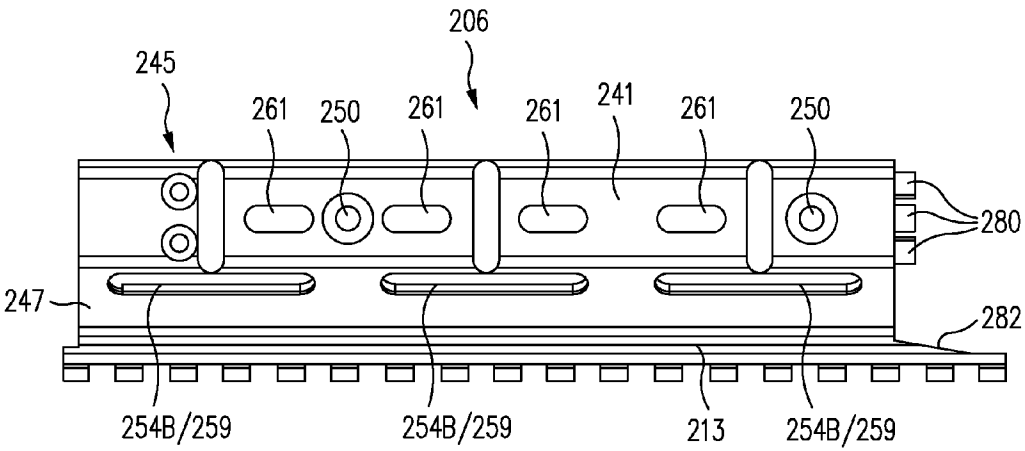
FIG. 14B is a left side elevation view of the lower part.
Figure 14C:
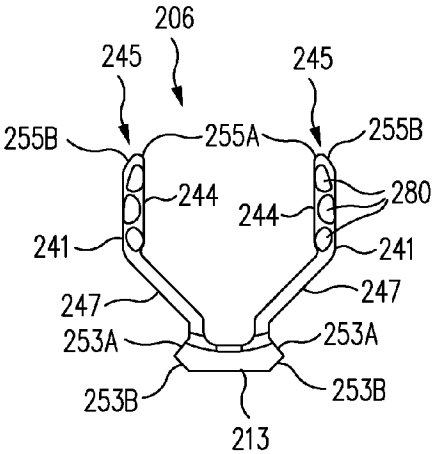
FIG. 14C is a rear end elevation view of the lower part.
Figure 14E:
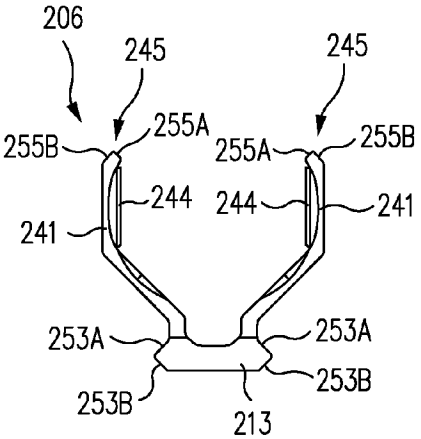
FIG. 14E is a front end elevation view of the lower part.
Figure 14D:
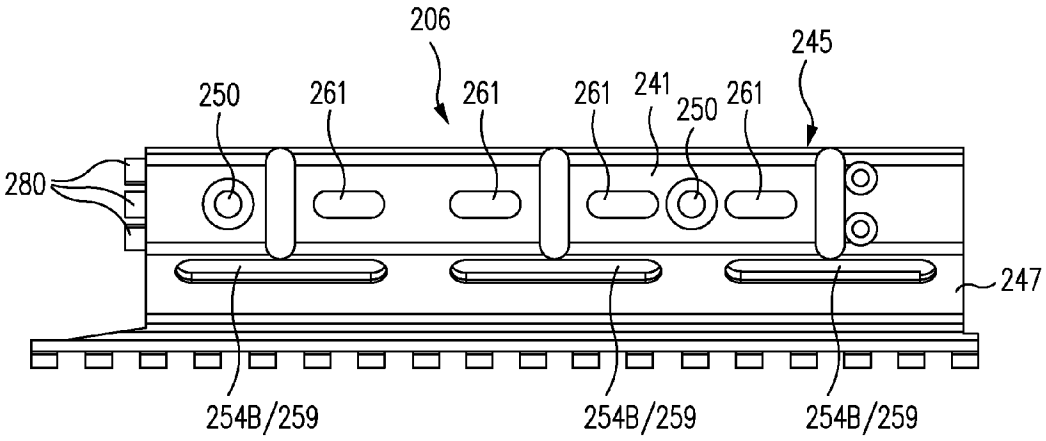
FIG. 14D is a right side elevation view of the lower part.
Figure 14F:
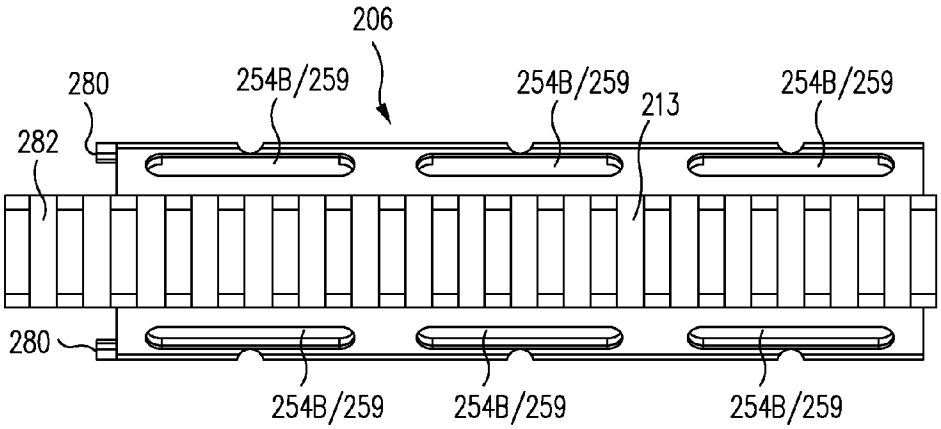
FIG. 14F is a bottom plan view of the lower part.
Figure 15A:
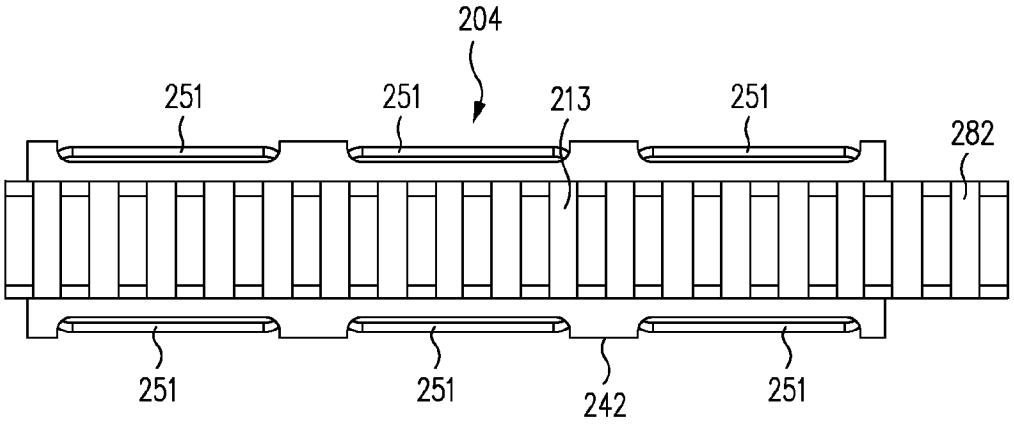
FIG. 15A is a top plan view of the upper part of the second example hand guard.
Figure 15B:
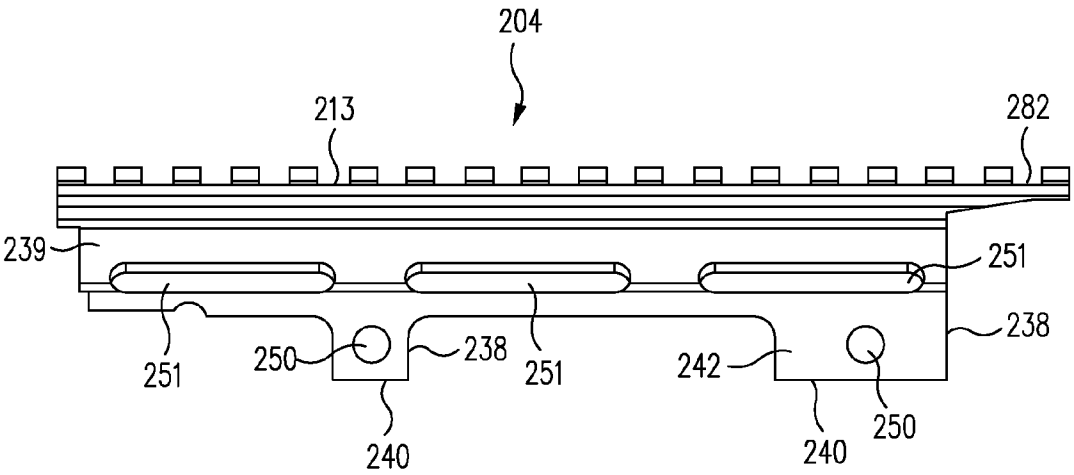
FIG. 15B is a left side elevation view of the upper part.
Figure 15C:
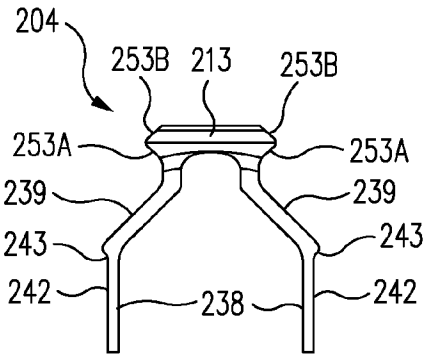
FIG. 15C is a rear end elevation view of the upper part.
Figure 15E:
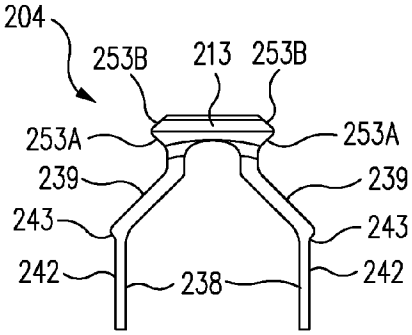
FIG. 15E is a front end elevation view of the upper part.

As illustrated in, e.g., FIGS. 13, 15B, 15C, and 15E, the upper part 204 of the housing 202 can include a pair of laterally spaced, downwardly extending lateral side walls 238, and inclined side walls 239 (e.g., inclined approximately 45 degrees relative to side walls 238). Each of side walls 238 include a generally planar exterior surface 242 and a flange 243 (e.g., a downwardly projecting engagement surface extending over lateral side walls 238). As illustrated in, e.g., FIGS. 13, 14C, and 16, the lower part 206 of the housing 202 can have a pair of laterally spaced, upwardly extending lateral side walls 241, and inclined side walls 247 (e.g., inclined approximately 45 degrees relative to side walls 241). Each of side walls 241 has a generally planar interior surface 244 and also an upper edge 245 (e.g., an upwardly projecting engagement surface at the intersection of angulated faces 255A-B). As illustrated in FIGS. 16 and 19A-19C, the side walls 238 of the upper part 204 are positionable inside the side walls 241 of the lower part 206 such that respective ones of the planar exterior surfaces 242 of the side walls 238 of the upper part 204 are disposed in facing opposition to corresponding ones of the planar interior surfaces 244 of the side walls 241 of the lower part 206. Moreover, flange 243 of upper part 204 may be brought into contact with upper edge 245 of lower part 206.

As illustrated in, e.g., FIGS. 12 and 13, the coupling mechanism can comprise a plurality of threaded fasteners 248 respectively extending laterally through apertures 250 in corresponding ones of the side walls 241 of the lower part 206 of the housing 202 and into corresponding threaded apertures 252 disposed in corresponding ones of the side walls 238 of the upper part 204 of the housing 202, and arranged such that advancement of the fasteners 248 into the threaded apertures 252 acts to pull the planar surfaces 242 of the side walls 238 of the upper part 204 into engagement with corresponding ones of the planar surfaces 244 of the side walls 241 of the lower part 206. In one embodiment, the threaded apertures 152 can be provided in the side walls 238 of the upper part 204 (e.g., integral therewith). In another embodiment, the threaded apertures 252 can be provided by separate components (e.g., nuts or bushings) that are pressed, welded, and/or otherwise attached positioned into corresponding apertures in the upper part 204 (e.g., positioned within the lumen 212 when the hand guard 200 is assembled).

Additionally, in some embodiments, the threaded apertures 252 in the side walls 238 of the upper part 204 can be disposed such that they are slightly higher (e.g., offset by a distance of 8 thousandths of an inch in one embodiment) than the apertures 250 in the side walls 241 of the lower part 206 when upper part 204 is inserted into lower part 206 (e.g., when flanges 243 of upper part 204 are in contact with upper edges 245 of lower part 206 but before upper part 204 and lower part 206 have been secured together). As threaded fasteners 248 are advanced into the threaded apertures 252, the offset between apertures 250 and 252 causes flanges 243 of the side walls 238 of the upper part 204 to be pulled into a tight engagement with the upper edges 245 of the side walls 241 of the lower part 206, thus ensuring a tight coupling of the upper part 204 to the lower part 206.

As illustrated in FIG. 13, in some embodiments, the apertures 250 can be implemented with frustoconical countersinks. In one embodiment, the countersinks can be offset downward or otherwise (e.g., by approximately 8 thousandths of an inch in one embodiment) such that the upper portions of the heads of the threaded fasteners 248 contact the rail 213 and/or the lower part 206 before the threaded fasteners 248 are fully screwed into the threaded apertures 252 and fully seated within the corresponding countersinks. Such contact can provide compressive force to further secure the upper part 204 and the lower part 206 together.

As illustrated in, e.g., FIGS. 12 and 13, selected ones or all of the side walls of the housing 102 can include a pattern of apertures 251 (e.g., in upper part 204) and 259 (e.g., in lower part 206). Apertures 251 and 259 reduce the weight of the second example hand guard 200 substantially, and also permit cooling of the barrel 24 of the rifle 10 during extended firing thereof, thereby ensuring that the hand guard 200 remains cool to the touch.

Additionally, as discussed below, apertures 251 and 259 may be used to implement elongated slots 254A-B to define rails 289 which may be used to mount accessories to the hand guard 200, e.g., such as, for example, rails 262 illustrated in FIGS. 10, 19A, and 19B, the accessory mounting bracket 201 illustrated in FIG. 11, and/or other accessories. In some embodiments, slots 254A may be defined by apertures 251 in inclined side walls 239 of upper part 204 and upper edge 245 of lower part 206. In some embodiments, slots 254B may be defined entirely by apertures 259 in inclined side walls 247 of lower part 206.

Figure 19A:
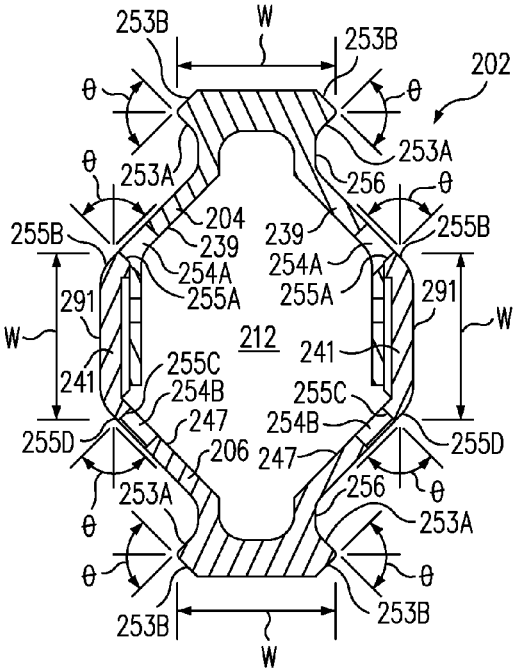
FIGS. 19A-19C are cross-sectional views of the second example hand guard, as seen along the lines of the section 16-16 taken in FIG. 12, showing various accessory and accessory bracket mounting features.
Figure 19B:
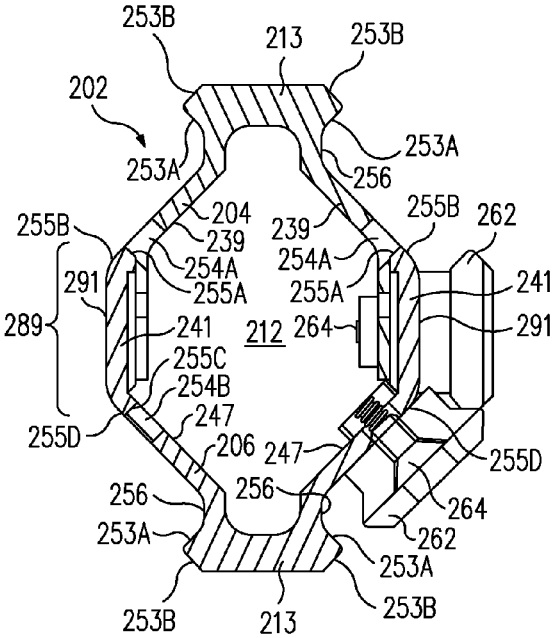
Figure 19C:
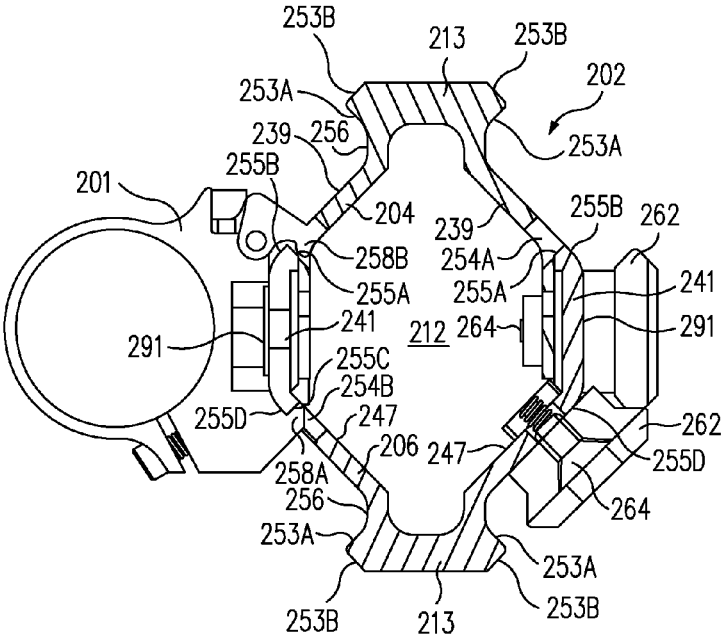

FIGS. 19A-19C are cross-sectional views of the second example hand guard 200, as seen along the lines of the section 16-16 taken in FIG. 12, showing various accessory and accessory bracket mounting features. As discussed above and illustrated in FIGS. 19A-19C, at least one of the side walls of the housing 202 can comprise an integral, longitudinal accessory mounting rail 213, such as specified in MIL-STD-1913 and commonly referred to as a "Picatinny" rail. In the particular example embodiment illustrated in the figures, the housing 202 includes two such integral accessory mounting rails 213, viz., one disposed atop the top wall of the upper part 204 of the housing 202, and one disposed on the bottom wall of the lower part 206 of the housing 202. In this regard, each side of rails 213 include two angulated faces 253A-B (see FIGS. 19A-C) which subtend an angle θ of about 90 degrees, and the width w between the respective intersection of the angulated faces 253A-B on either side of each rail 213 is about 0.835 inches.

Additional side rails 289 may be provided with "Picatinny rail" features, but having a substantially reduced height relative to conventional Picatinny rails 213 (e.g., without the "neck" portion 256 of the conventional Picatinny rail 213). In this regard, rails 289 include angulated faces 255A-B and 255C-D provided on opposite sides of lateral side walls 241 and proximate to slots 254A-B. Slots 254A (e.g., having perimeters defined by apertures 251 in inclined side walls 239 of upper part 204 and upper edge 245 of lower part 206 as discussed) define angulated faces 255A (e.g., interior facing angulated faces corresponding to portions of upper edge 245 of lower part 206). Slots 254B (e.g., having perimeters defined by apertures 259 in inclined side walls 247 of lower part 206 as discussed) define angulated faces 255C (e.g., interior facing angulated faces). External surfaces of lateral side walls 241 may provide angulated faces 255B and 255D (e.g., exterior facing angulated faces).

Angulated faces 255A-B and 255C-D of rails 289 may exhibit the same angle θ and the same width w as described for angulated faces 253A-B of rails 213. However, as can be seen in FIGS. 19A-C, the respective outer surfaces 291 of rails 289 are generally coplanar with the respective outer surfaces of the side walls 241 of the lower part 206. Thus, the "neck" portion 256 of the conventional Picatinny rail 213 is eliminated in rails 289, resulting in a lighter, narrower, easier-to-grip hand guard 200 without any sacrifice in accessory mounting capabilities.

Figure 18A:
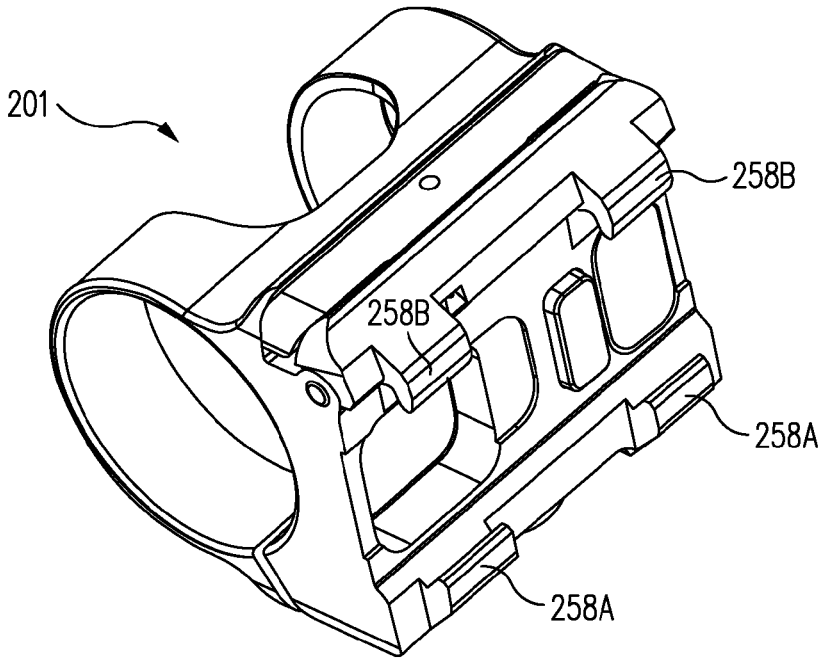
FIG. 18A is an upper, front, left side perspective view of the example accessory mounting bracket of FIG. 11.
Figure 18B:
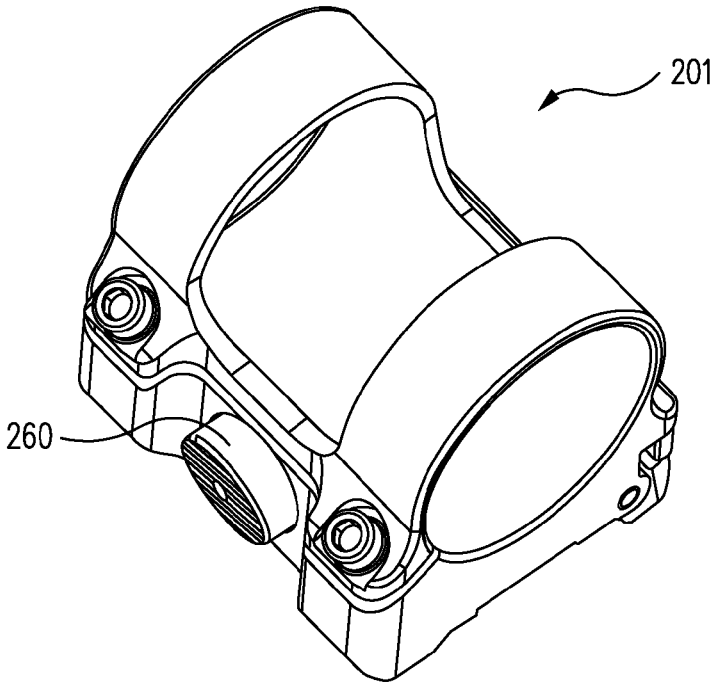
FIG. 18B is an upper, front, right side perspective view of the mounting bracket.

FIG. 18A is an upper, front, left side perspective view of the example accessory mounting bracket 201 shown in FIG. 11, and FIG. 18B is an upper, front, right side perspective view thereof. The bracket 201 can be configured to mount, for example, a light 190 discussed above in connection with FIG. 3. As illustrated in FIG. 18A, in some embodiments, the mounting bracket 201 can comprise two pairs of fingers 258A and 258B configured to engage a Picatinny rail. In some implementations, the pair of fingers 258A can be fixed on the bracket 201 and the other pair of fingers 258B can be arranged to pivot toward and away from the fixed pair 258A, for example, by depressing the head of an actuating member 260 of the type illustrated in FIG. 18B. As illustrated in FIG. 19C, this arrangement enables the mounting bracket 201 to be clamped to a side wall (e.g., as fingers 258A-B extend through slots 254 and around side wall 241) of the housing 202 using the "reduced-height" Picatinny rail design discussed above.

If desired, conventional Picatinny accessory mounting rails 262 can be mounted on the outer surfaces of the side walls of the upper and/or lower parts 204 and 206 of the hand guard housing 202 (e.g., mounted on rails 289, using apertures 251 of upper part 204, using apertures 259 of lower part 206, using apertures 261 in lateral side walls 241, and/or others). As illustrated in the figures, these can be mounted to corresponding ones of the side walls using, for example, threaded fasteners 264 (e.g., see FIGS. 19B-C), but it should be understood that they can also be mounted to the housing 202 using other fastening techniques, such as riveting, adhesive bonding and the like.

Figure 21:
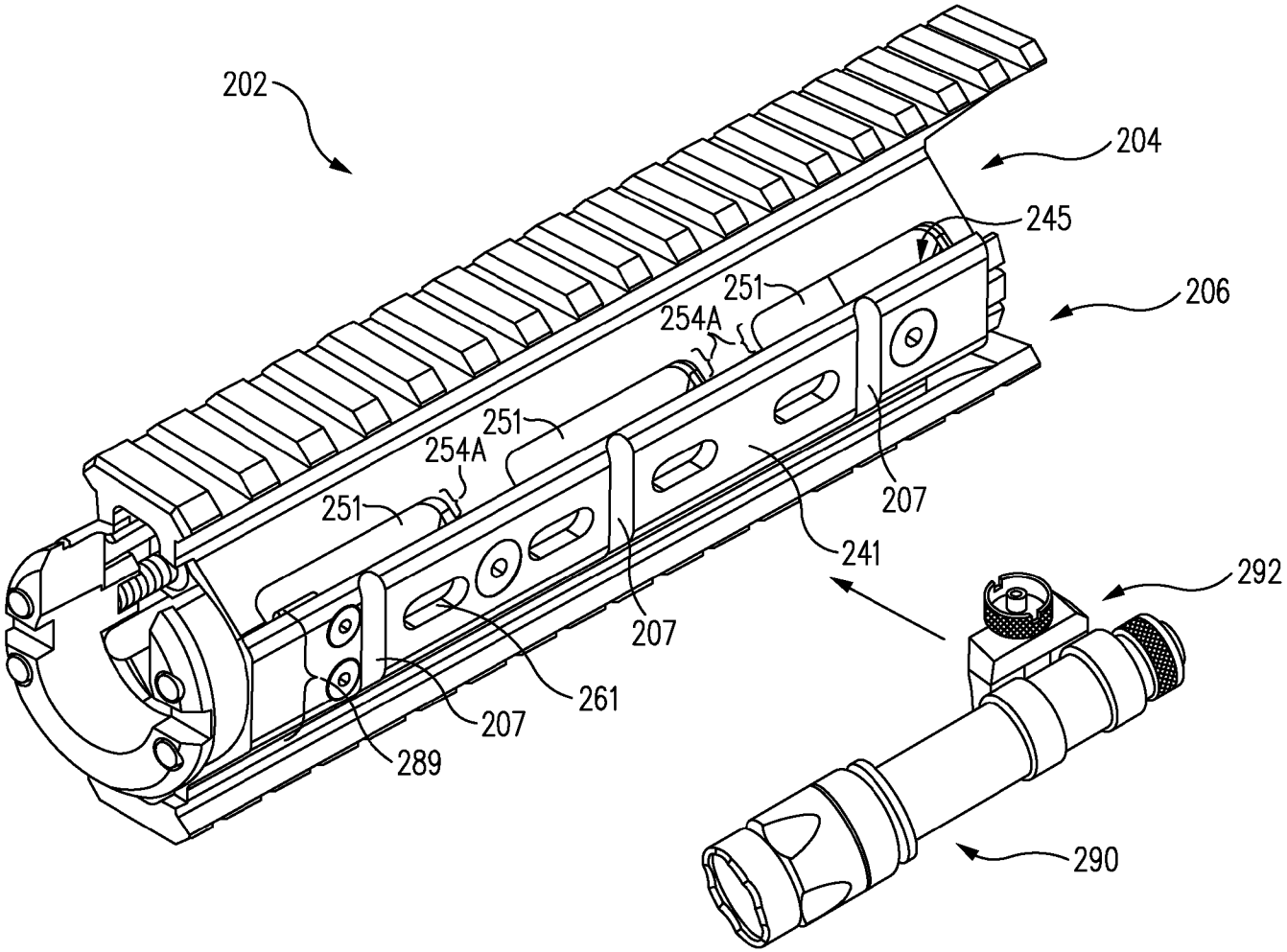
FIG. 21 illustrates a lighting device attached to a clamp mount that may be attached to a lateral side wall of the second example hand guard.

As shown in FIG. 21, side walls 241 of lower part 206 include recesses 207. Recesses 207 may be used to position various types of accessories, such as clamp mounts and/or other devices, on hand guard 200. For example, FIG. 21 illustrates a lighting device 290 (e.g., a SureFire Scout Light in one embodiment) attached to a clamp mount 292. Clamp mount 292 is more clearly shown in the assembled view of FIG. 22 and the exploded view of FIG. 23.

Clamp mount 292 may include a bolt 293, a first clamp member 294, a roll pin 295, a second clamp member 296, a washer 297, a split lock washer 298, and a nut 299. Clamp mount 292 may be installed on a side wall 241 using slots 254 in a similar manner as described with regard to mounting bracket 201, For example, rotation of nut 299 may cause first and second clamp members 294 and 296 to be pulled toward each other to cause at least a flange 296A of second clamp member 296 to extend around side wall 241.

Figure 22:
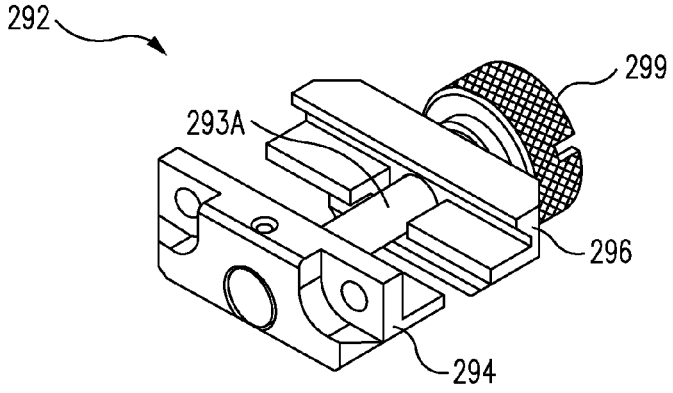
FIG. 22 illustrates the clamp mount of FIG. 21.
Figure 23:
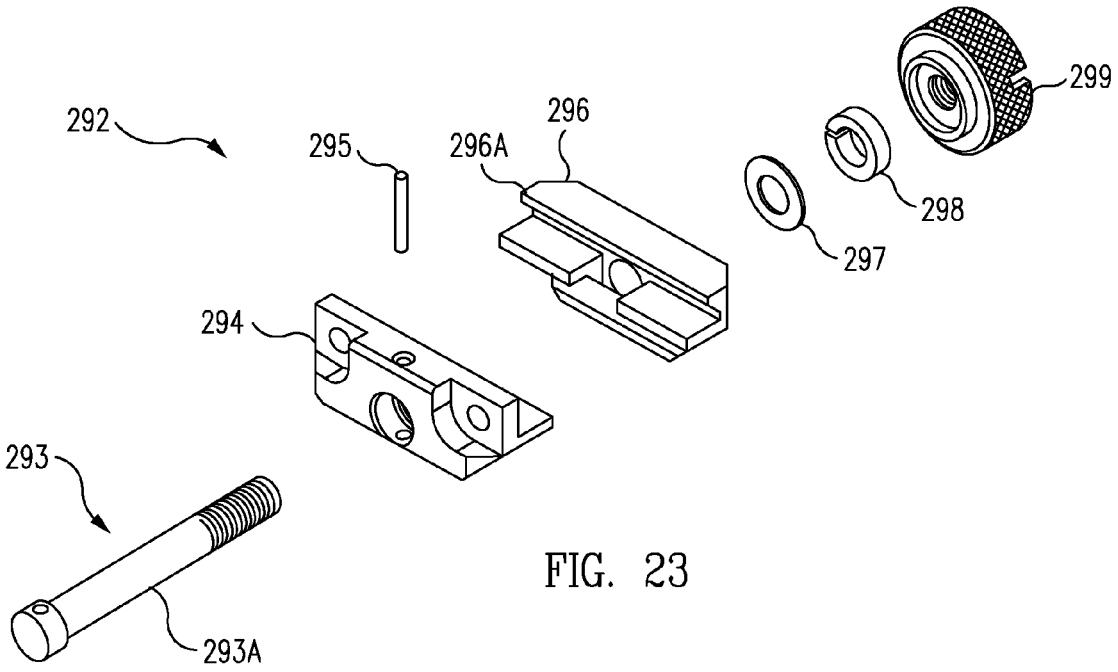
FIG. 23 illustrates an exploded view of the clamp mount of FIG. 21.

As shown in FIG. 22, when clamp mount 292 is assembled, a shank 293A of bolt 293 is exposed. Recesses 207 in side walls 241 may be configured (e.g., having substantially scalloped and/or rounded interior surfaces complimentary to shank 293A) to receive shank 294A while clamp mount 292 is installed. Such engagement of a recess 207 with shank 294A permits clamp mount 292 to be conveniently and rapidly positioned at one or more predetermined positions along (e.g., relative to) side wall 241. Other configurations of recesses 207 and clamp mounts 292 may be used where appropriate.

Figure 24:
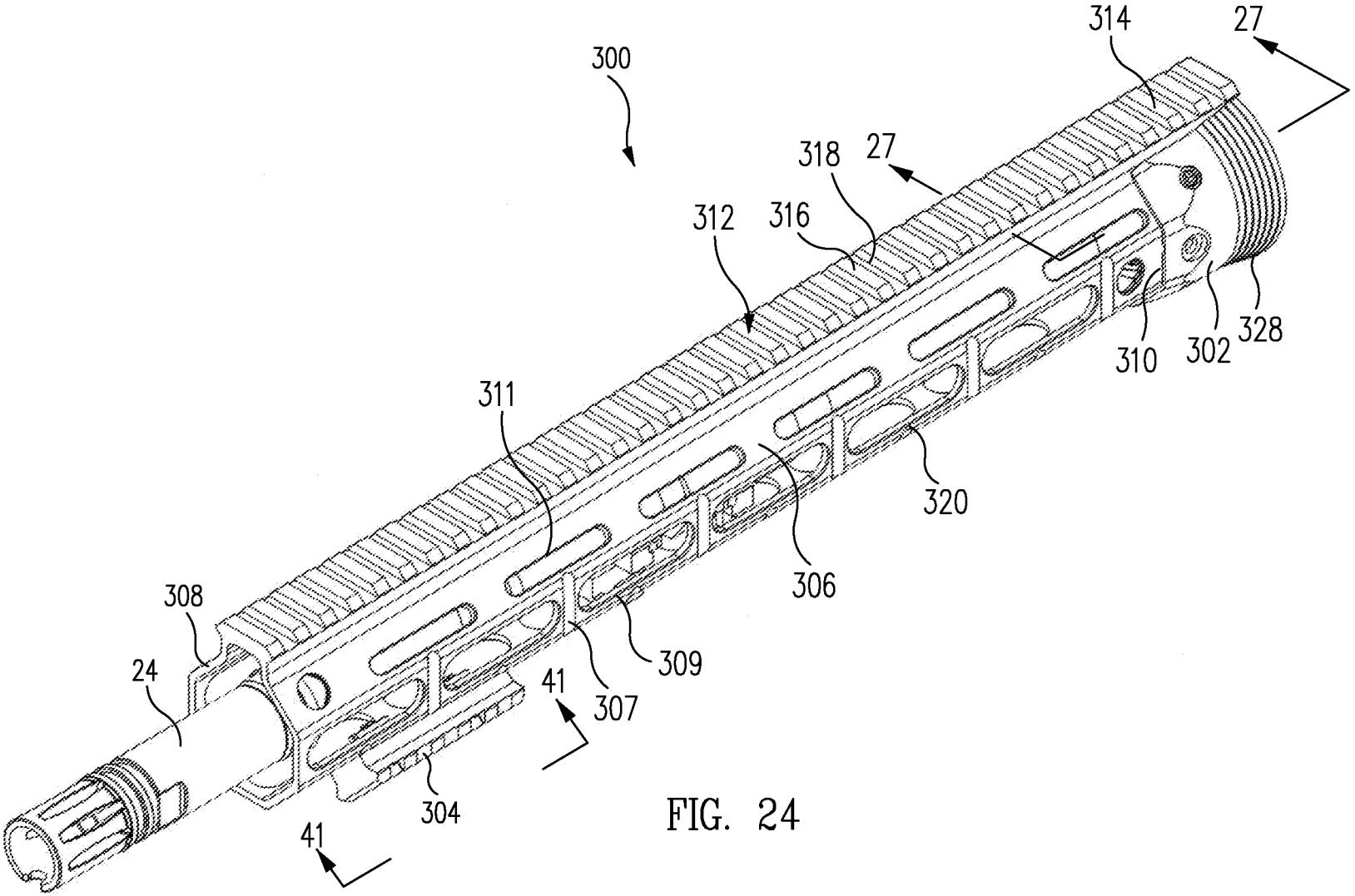
FIG. 24 is an upper left side perspective view of portion of an M4 rifle, showing a third example embodiment of a hand guard with a hand guard mounting assembly in accordance with the present disclosure mounted thereon.
Figure 25:
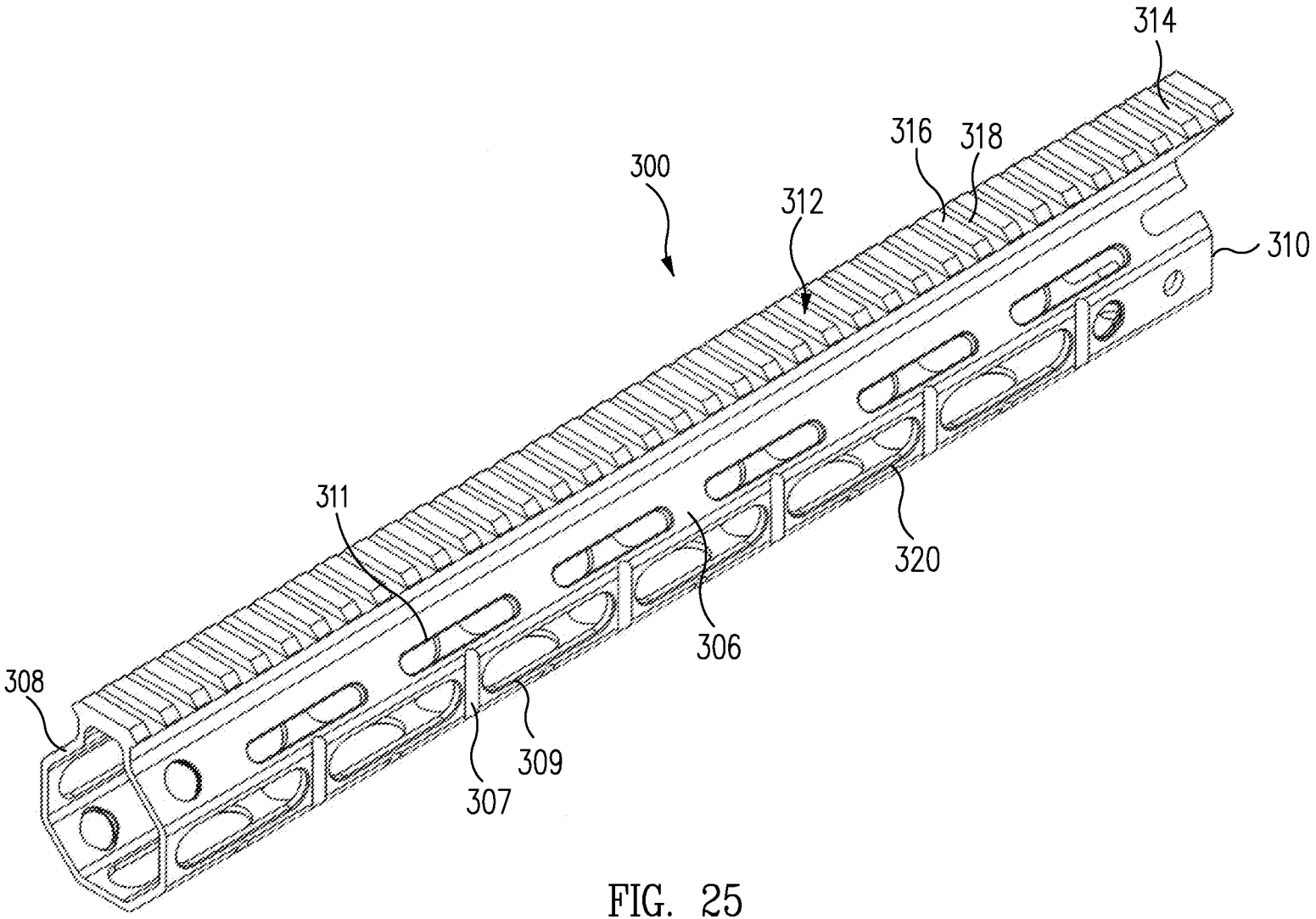
FIG. 25 is an upper, front, left side perspective view of the third example hand guard of FIG. 24.
Figure 26A:
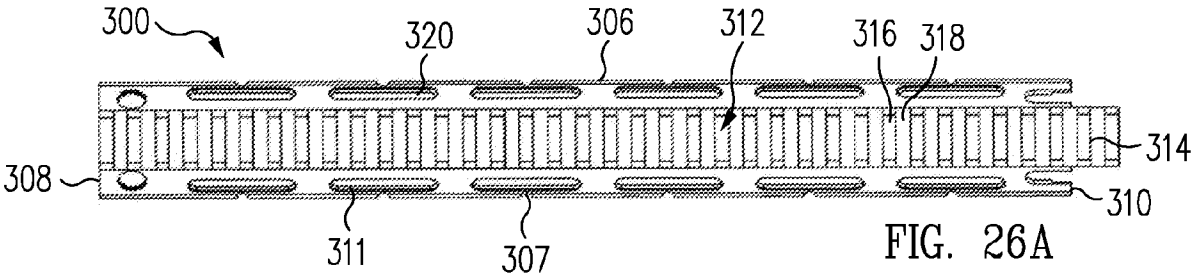
FIG. 26A is top plan view of the third example hand guard.
Figure 26C:
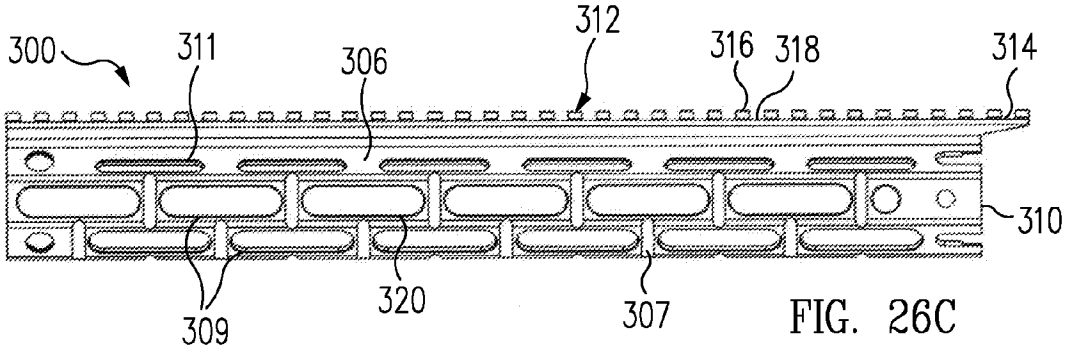
FIG. 26C is a left side elevation view of the third example hand guard.
Figure 26B:
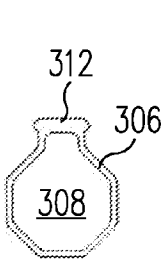
FIG. 26B is a front end elevation view of the third example hand guard.
Figure 26D:
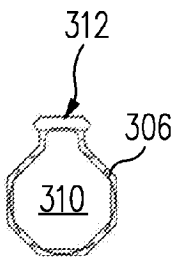
FIG. 26D is a rear end elevation view of the third example hand guard.
Figure 26E:
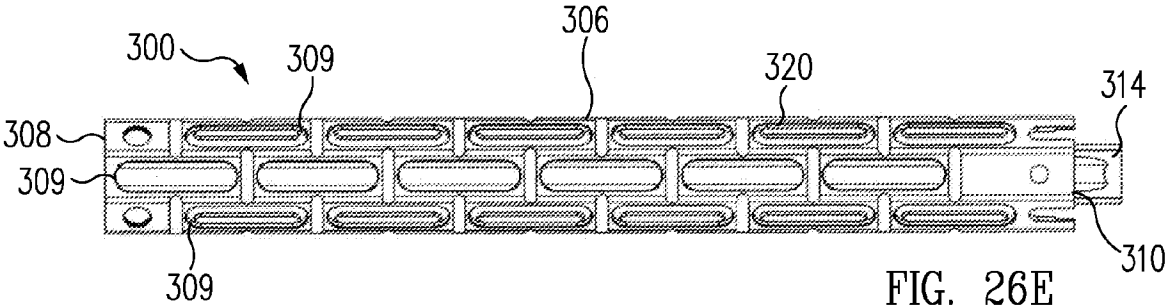
FIG. 26E is a bottom plan view of the third example hand guard.

A third example embodiment of a hand guard 300 and associated hand guard mounting assembly 302 in accordance with the present disclosure are illustrated in the upper, front and left side perspective view of FIG. 24, wherein a receiver and rear stock of an associated firearm are omitted for purposes of illustration. FIG. 25 is an upper, front, left side perspective view of the third example hand guard 300 of FIG. 24, in which the mounting assembly 302, the barrel 24 and slip ring 40/328 of the associated firearm, and an accessory mounting rail 304 coupled to a front end portion of a side wall of the hand guard 300 have been omitted for purposes of illustration. FIGS. 26A-26E are top plan, front end elevation, left side elevation, rear end elevation, and bottom plan views of the third example hand guard 300, respectively.

As can be seen in these figures, the third example hand guard 300 includes many of the same features present in the first and second example hand guards 100 and 200 described above, in that it comprises an elongated tubular housing 306 having open front and rear ends 308 and 310, a central lumen extending between the two ends, and includes an upper surface that comprises an elongated accessory mounting rail 312. As in the above embodiments, the mounting rail 312 can include a rearwardly extending "tail piece" or protrusion 314 that overlies a front portion the receiver (not illustrated) of the associated firearm and forms an continuation of a similar mounting rail disposed on the upper surface of the receiver, as illustrated in the example embodiment of, e.g., FIG. 10.

In the particular example embodiment illustrated, the tubular housing 306 can, in one embodiment, comprise a single piece that is fabricated, for example, as an extrusion of, e.g., an aluminum alloy, e.g., 6061, that is subsequently machined to form such accessory mounting features as transverse lands 316, grooves 318, and various through-apertures 320 of desired shapes and sizes. It can then, for example, be hard anodized otherwise finished or coated to provide robust corrosion protection. In some embodiments, the tubular housing 306 can be polygonal in cross-section, e.g., octagonal, so as to provide a plurality of generally flat side walls for the mounting of a variety of firearm accessories, or as illustrated in FIG. 24, an accessory mounting rail 304, such as a Picatinny rail, upon which an accessory, e.g., a light, a telescopic sight, or the like can be mounted.

Figure 16:
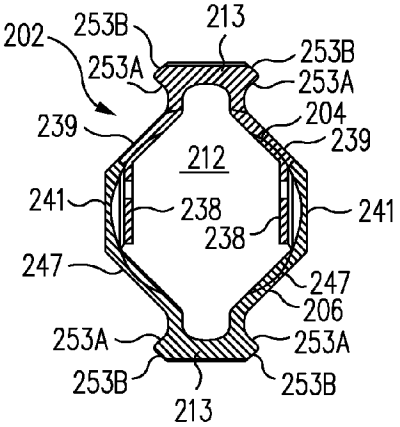
FIG. 16 is a cross-sectional view through the second example hand guard, as seen along the lines of the section 16-16 taken in FIG. 12.
Figure 15D:
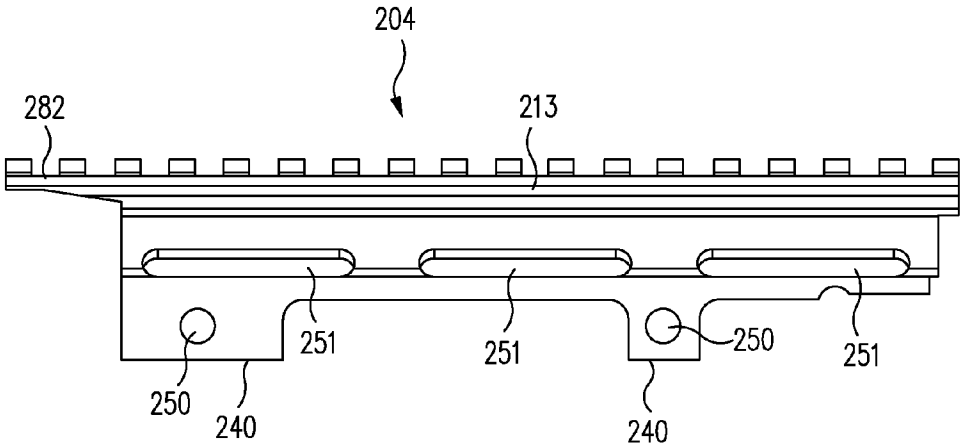
FIG. 15D is a right side elevation view of the upper part.
Figure 15F:
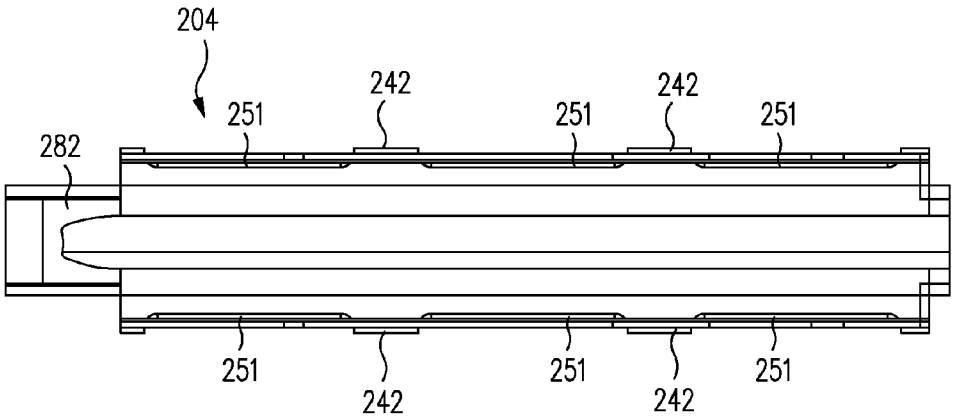
FIG. 15F is a lower plan view of the upper part.

Alternatively, the tubular housing 306 can comprise two or more components that are assembled together during manufacture (e.g., welded together), or assembled together with, e.g., fasteners, to form the tubular structure 306, such as the first and second hand guards 100 and 200 discussed above and illustrated in, e.g., FIGS. 6 and 16, respectively.

Advantageously, housing 306 includes various apertures 309 and 311 of differing sizes on 7 sides of the octagonal shape of housing 306, and further includes recesses 307 and rail 312. As a result, a variety of accessories and/or additional rails may be mounted to housing 306 using apertures 309, apertures 311, recesses 307, and/or rail 312 in many convenient and flexible orientations (e.g., around the entire perimeter of housing 306), for example, in accordance with the various techniques described herein.

The third example hand guard 300 is coupled to the associated firearm in a manner that differs from the first and second hand guards 100 and 200 described above. In particular, hand guard 300 is mounted using the hand guard mounting assembly 302. As illustrated in, e.g., FIG. 24, the mounting assembly 302 couples to a rear end portion of the tubular housing 306 of the hand guard 300. In particular, as will be seen from the discussion below, the third example hand guard 300 is cantilevered forwardly from a front end of the receiver of the associated firearm (not illustrated) by the mounting assembly 302, and through the agency of a barrel nut 326 of the firearm discussed below, such that the barrel 24 of the firearm is disposed concentrically within the lumen of the tubular housing 306 and such that no contact is made between the housing 306 and the barrel 24.

This type of mounting is particularly advantageous in that, since no contact of any kind is made between the barrel 24 and the tubular housing 306 of the hand guard 300, the hand guard 300 cannot exert any undesirable bending or torsional stresses on the barrel 24 which could adversely affect the accuracy of the firearm. In this regard, the hand guard 300 is permitted to surround and "float" proximate to the barrel 24. As a result, even if the hand guard 300 receives external forces (e.g., when pushed upwardly at the front end while supported from the ground or a structure), such forces will not bias the barrel 24, and sighting accuracy can be maintained. As another example, thermal expansion of the firearm will not cause the hand guard 300 to shift, thus maintaining the accuracy of aiming devices attached to the hand guard 300.

Figure 27:
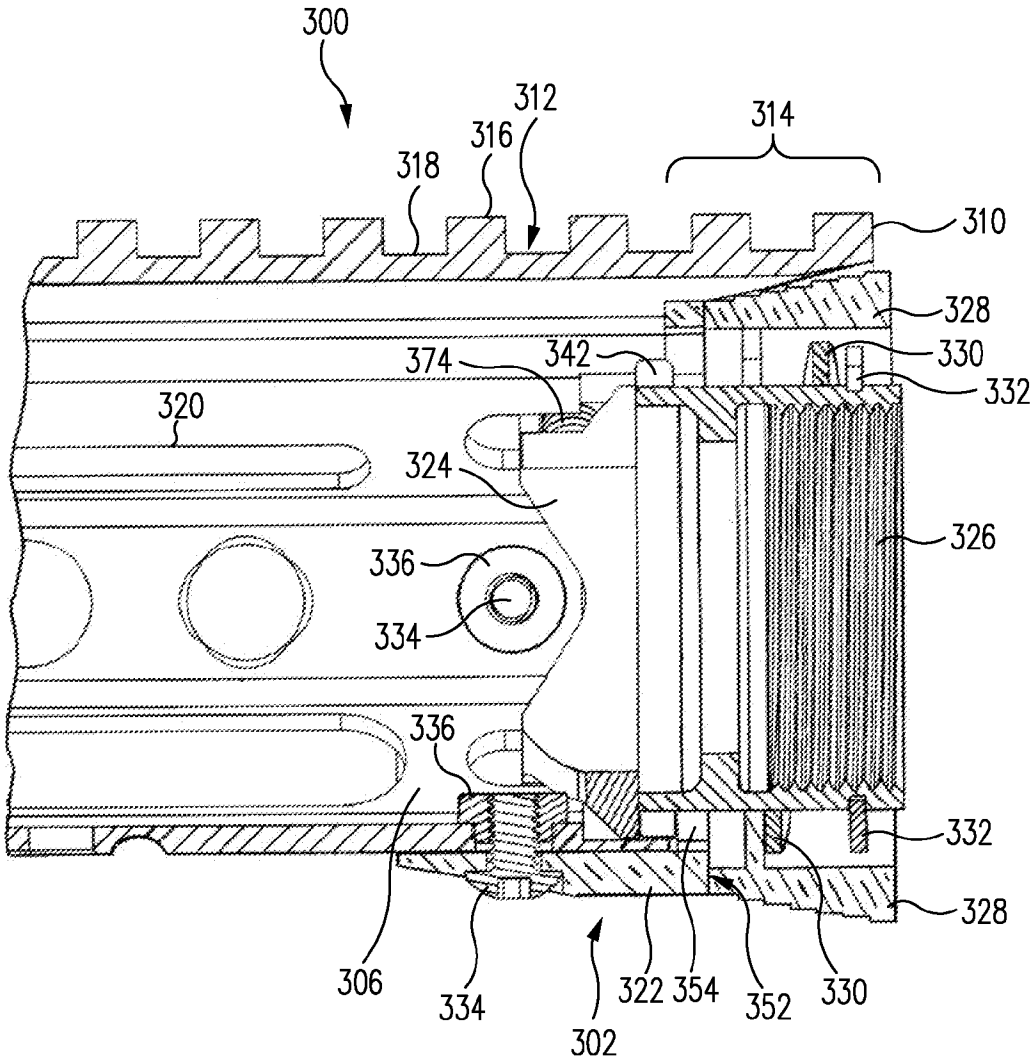
FIG. 27 is a partial cross-sectional view of the third example hand guard and an example embodiment of a hand guard mounting assembly therefor in accordance with the present disclosure, as seen along the lines of the section 27-27 taken in FIG. 24.

FIG. 27 is an enlarged partial cross-sectional view of the third example hand guard 300 and the mounting assembly 302 therefor in accordance with the present disclosure, as seen along the lines of the section 27-27 taken in FIG. 24. In the particular example embodiment of FIG. 27, the mounting assembly 302 comprises an annular barrel nut interface 322 and a wedge ring 324, which are both illustrated in more detail in FIGS. 35A-35D and 36A-36D, respectively. Also seen in FIG. 27 are various features with which the mounting assembly 302 interfaces, viz., a barrel nut 326 and a slip ring 328 (e.g., also referred to as a "D ring" or "Delta ring", which in some embodiments may be similar to slip ring 40 discussed here), which are illustrated in more detail in FIGS. 37A-37D and 38A-38D, respectively. The slip ring 328 is biased forwardly on the barrel nut 326 and relative to the receiver of the firearm by a slip-ring spring 330, which is disposed concentrically within the slip ring 328 and about the barrel nut 326 and retained in place by a snap ring 332, illustrated in FIG. 40.

As can be seen in, e.g., FIG. 27, the mounting assembly 302 couples concentrically to a rear end portion of the tubular housing 306, which is effected through a plurality of threaded fasteners 334, each of which extends radially inward through corresponding through-holes in the barrel nut interface 322 engages in corresponding threaded receptacles 336, e.g., swage nuts, retained in the tubular housing 306. Advantageously, such radial orientation of fasteners 334 reduces the likelihood of them becoming loose during repeated or sustained weapon fire (e.g., in contrast to certain prior longitudinally-secured hand guards which may be susceptible to loosening in response to repeated forward and rearward movement of the weapon during firing).

In the particular embodiment illustrated, three fasteners 334 and corresponding receptacles 336, respectively located on the two lateral sides and the bottom side of the tubular housing 306, are used to couple the mounting assembly to the tubular housing 306. In various embodiments, the hand guard mounting assembly 302 may attach to the receiver of the host firearm first, and then the tubular housing 306 may attach to the mounting assembly 302, or alternatively, the mounting assembly 302 may attach to the tubular housing 306 first, then the mounting assembly 302 may attach to the receiver of the host firearm, whichever is more convenient.

FIG. 37A is an upper and left side perspective view of the barrel nut 326 utilized in the host firearm and with which the example tubular housing 306 and hand guard mounting assembly 302 interface. FIG. 37B is a front end elevation view of the barrel nut 326, FIG. 37C is a left side elevation view thereof, and FIG. 37D is a rear end elevation view thereof. As may be seen in these figures, the barrel nut 326 comprises an elongated, annular barrel portion 333, which is internally threaded to receive complementary external threads on the host firearm, and a flange 335 that extends radially outward disposed on a front end thereof. As can be seen in, e.g., FIGS. 37A-37D, the flange 335 includes a front face 338, a rear face 340, a plurality of teeth (e.g., tines) 342 extending radially outward from it, and a plurality of arcuate scallops 344 (e.g., also referred to as key ways) extending radially into it and alternating with respective ones of the tines 342. Also seen in, e.g., FIGS. 37A and 37C is a circumferential channel 346 within which the snap ring 332 that retains the slip ring spring 330 is installed. The radial tines 342 and scallops 344 are arranged in a rotationally symmetrical fashion about a centerline of the flange 335 and barrel nut 326, and hence about the centerline of the barrel 24.

Figure 30:
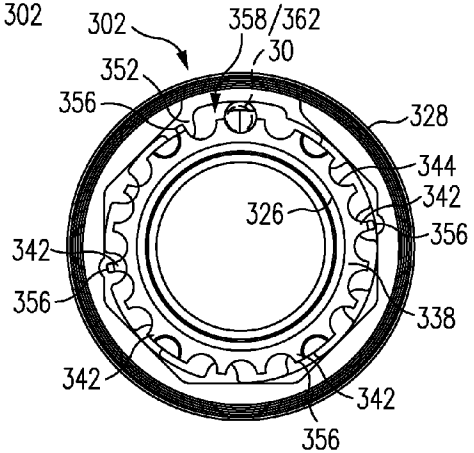
FIG. 30 is a cross-sectional view of the hand guard mounting assembly, as seen along the lines of the section 30-30 taken in FIG. 29.
Figure 29:
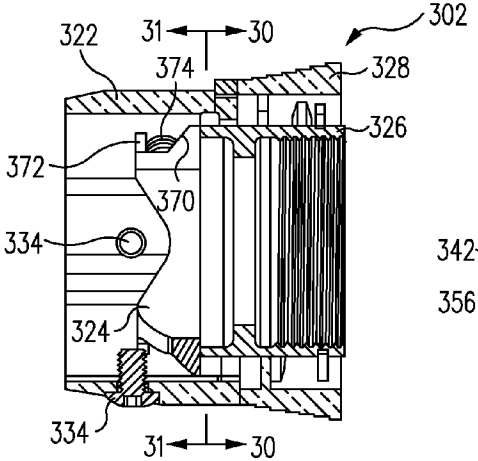
FIG. 29 is a cross-sectional view of the example hand guard mounting assembly, as seen along the lines of the section 29-29 taken in FIG. 28.
Figure 28:
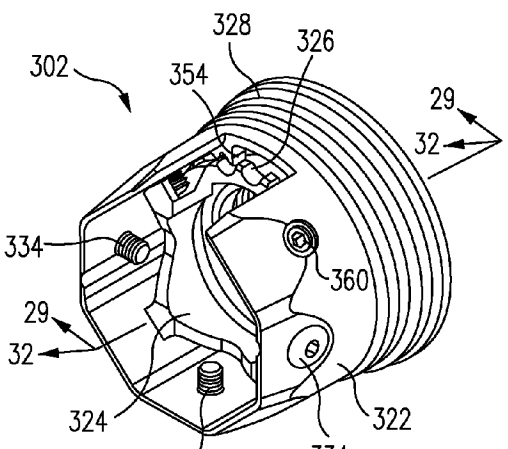
FIG. 28 is an upper left side perspective view of the example hand guard mounting assembly of the third example hand guard of FIG. 27, wherein the hand guard is omitted for purposes of illustration.
Figure 31:
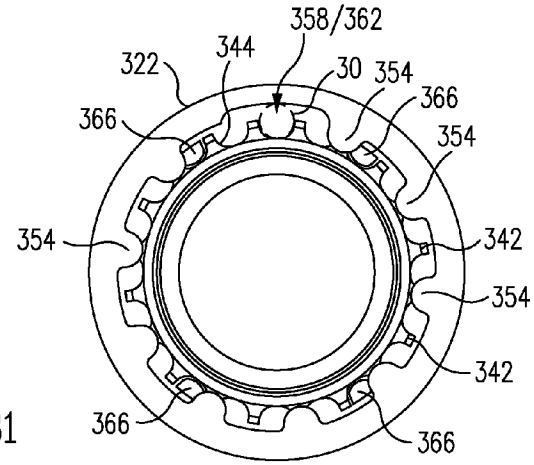
FIG. 31 is a cross-sectional view of the hand guard mounting assembly, as seen along the lines of the section 31-31 taken in FIG. 29.

As discussed above in connection with FIG. 1A, gas operated firearms of the types contemplated herein employ a gas tube 30 (shown in dashed outline in, e.g., FIGS. 30, 31)

that conveys combustion gases from a port in the barrel 24 located in a distal portion of the barrel 24 to the receiver of the firearm, which are used by components in the receiver for the automatic actuation of the firearm when it is fired. The gas tube 30, like the barrel 24 and barrel nut 326, extends forwardly from the center of the receiver at a 12 o'clock position, i.e., disposed above the centerline of barrel of the firearm. The scallops 344 in the flange 335 of the barrel nut 326 are semicircular and have a diameter about the same as the gas tube 30. Thus, as seen in, e.g., FIGS. 37B and 37D, the gas tube 30 can be used as an "index" to orient the rotational position of the barrel nut 326 and the barrel 24 of the firearm relative to its receiver by installing the barrel nut 326 such that the gas tube 30 nests radially within one of the scallops 344 of the flange 335. In this arrangement, a vertical or sagittal plane 348 through the centerline of the barrel 24 bisects the gas tube 30, the barrel 24, the barrel nut interface 322, the wedge nut 324, the barrel nut 326, and the tubular housing 306. Additionally, it should be noted that each of the foregoing structures are disposed concentric to the centerline of the barrel 24 in some embodiments.

FIG. 35A is an upper and left side perspective view of a barrel nut interface 322 of the example hand guard mounting assembly 302. FIG. 35B is a front end elevation view of the barrel nut interface 322, FIG. 35C is a left side elevation view thereof, and FIG. 35D is a rear end elevation view thereof. As can be seen in these figures, the barrel nut interface 322 comprises a generally annular structure having a flange 350 extending radially inward at a rear end 352 thereof. The internal flange 350 of the barrel nut interface 322 defines a forward facing transverse surface comprising a plurality of substantially semicircular tabs 354 extending radially inward and substantially conforming in size, shape, and location to the scallops 344 of the barrel nut 326.

As may be seen in, e.g., FIG. 35B, selected ones of these tabs 354 include indentations 356 formed in the forward facing surface of the tabs 354. The indentations 356 are configured to receive a corresponding one of the tines 342 on the flange 335 of the barrel nut 326 longitudinally, i.e., in a front-to-rear direction, in a manner described in more detail below. In the particular embodiment illustrated in FIGS. 30 and 35B, there are four such longitudinal indentations 356, each formed in a respective one of the tabs 354. In some embodiments, the number of indentations 356 and/or the number of tabs 354 can be varied, including up to one indentation 356 per tab 354.

Also, as may be noted in FIGS. 35B and 35D, the flange 350 at the rear of the barrel nut interface 322 includes a cutout 358 configured to clear the gas tube 30 extending forwardly from the receiver at the 12 o'clock position thereon. Additionally, as can be seen in, e.g., FIGS. 35A and 35C, the barrel nut interface 322 includes four circumferentially distributed, radially extending threaded receptacles 360, each of which is configured to receive a corresponding one of four set screws 374, which, as described in more detail below, are used both to retain the wedge ring 324 concentrically within the barrel nut interface 322 and to advance the wedge nut 324 longitudinally toward the forward facing surface of the flange 350 of the barrel nut interface 322. Similar to fasteners 334, the radial orientation of set screws 374 reduces the likelihood of them becoming loose during repeated or sustained weapon fire.

FIG. 36A is an upper and left side perspective view of the wedge ring 324 of the example mounting assembly 302. FIG. 36B is a front end elevation view of the example wedge ring 324, FIG. 36C is a left side elevation view thereof, and FIG. 36D is a rear end elevation view thereof. The wedge ring 324 comprises a generally annular structure that includes a central bore through which the barrel 24 of the host firearm extends and an arcuate space 362 in its circumfery that, like the cutout 358 in the flange 350 of the barrel nut interface 322, is adapted to clear the gas tube 30 when the wedge ring 324 is disposed in its operating position.

As can be seen in FIGS. 36C and 36D, the wedge ring 324 includes a rearward facing transverse surface 364 having a plurality of rearwardly extending lands 366 disposed thereon, each substantially conforming in size, shape and location to one of the scallops 344 in the flange 335 of the barrel nut 326. In the particular example embodiment illustrated, there are four rearwardly extending lands 366 disposed in a bilaterally symmetrical relationship relative to a sagittal plane of the wedge ring 324, but as in the case of the indentations 356 in the flange 350 of the barrel nut interface 322, the number and angular positions of the lands 366 can be varied within limits, such that they substantially align with a corresponding one of the scallops 344 in the flange 335 of the barrel nut 326 when the wedge ring 324 is disposed in its clamping position described below.

Figure 32:
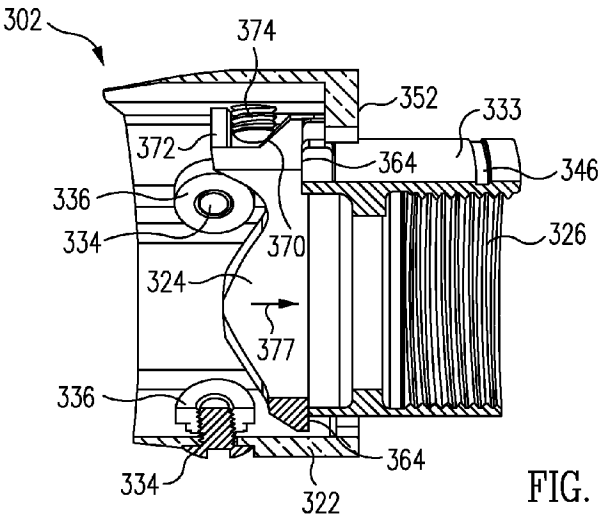
FIG. 32 is a cross-sectional view of the of the hand guard mounting assembly, as seen along the lines of the section 32-32 taken in FIG. 28, wherein a slip ring of the host rifle is omitted for purposes of illustration.

Additionally, the wedge ring 324 includes a plurality, e.g., four, L-shaped mounting and clamping adjustment features 368 extending forwardly from a front surface thereof. Each L-shaped feature 368 comprises a plane 370 that is inclined relative to both the longitudinal and radial directions and a radially extending leg 372 disposed forwardly of the inclined plane 370. As illustrated in, e.g., FIG. 32, the inclined plane 370 and radial leg 372 act in cooperation with a corresponding set screw 374 extending in a radial direction through a corresponding one of the four threaded receptacles 360 in the sides of the barrel nut interface 322 described above to: retain the wedge ring 324 concentrically within the barrel nut interface 322 and; when the set screws 374 are advanced radially inward against corresponding ones of the inclined planes 370, to urge the rearward facing transverse surface 364 of the wedge ring 324 rearwardly, in the direction of the arrow 377 in FIG. 32, and against the front face 338 of the flange 335 of the barrel nut 326 so as to clamp the flange 335 firmly between the rearward facing surface 364 of the wedge ring 324 and the forward facing surfaces of the tabs 354 of the barrel nut interface 322.

Thus, in one embodiment, the set screws 374 in the barrel nut interface 322 can be backed out of their receptacles 360 until the body of the wedge ring 324 and the tops of the radial legs 372 clear the ends of the set screws 374. The wedge ring 324 can then be inserted longitudinally forward in the barrel nut interface 322 such that the wedge ring 324 is disposed generally concentrically within the barrel nut interface 322, the arcuate space 362 in the circumfery of the wedge ring 324 is generally aligned with cutout 358 the gas tube 30 in the rear end of the barrel nut interface 322 and each of the inclined planes 370 is disposed below a corresponding one of the set screws 374. The set screws 374 can then be advanced radially within their respective receptacles 360 in the barrel nut interface 322 until their ends contact a corresponding one of the inclined planes 370, at which point the wedge ring 324 is retained concentrically within the barrel nut interface 322 and the hand guard mounting assembly 302 is prepared for assembly to the host firearm.

Figure 38A:
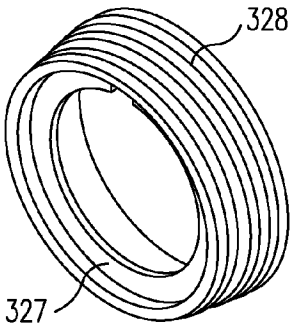
FIG. 38A is an upper and left side perspective view of a slip ring of a type utilized in a host rifle.
Figure 38B:
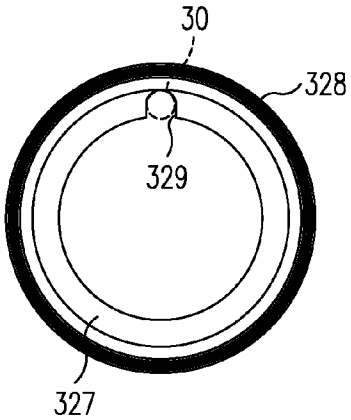
FIG. 38B is a front end elevation view of the slip ring.
Figure 38C:
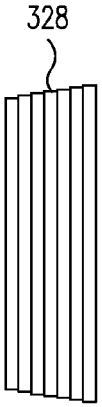
FIG. 38C is a left side elevation view thereof.
Figure 38D:
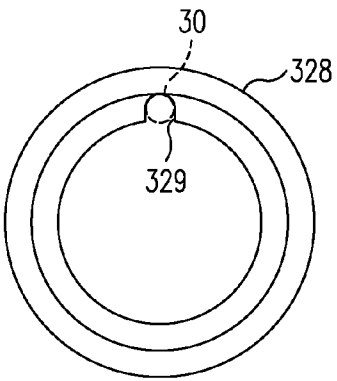
FIG. 38D is a rear end elevation view thereof.

A slip ring 328 of a type employed on the host firearms contemplated herein is illustrated in the upper and left side perspective view of FIG. 38A. FIG. 38B is a front end elevation view of the slip ring 328, FIG. 38C is a left side elevation view thereof, and FIG. 38D is a rear end elevation view thereof. As can be seen in the figures, the slip ring 328 comprises an annular, generally frusto-conical structure having a stepped circumferential surface. As can be seen in, e.g., FIGS. 38B and 38D, the slip ring 328 includes a notch 329 similar to the cutout 358 in the rear end of the barrel nut interface 322 and the arcuate space 362 in the circumfery of the wedge ring 324 that is configured to clear the gas tube 30 (shown in dashed outline) extending forwardly from the receiver of the host firearm.

Figure 39A:
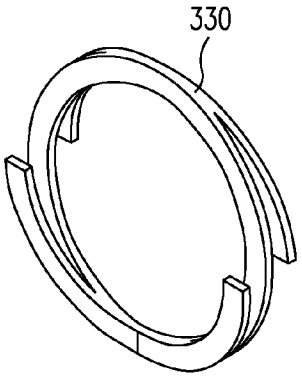
FIG. 39A is a upper and left front perspective view of a slip-ring spring of a type utilized in conjunction with the slip ring of FIGS. 38A-38D.
Figure 39B:
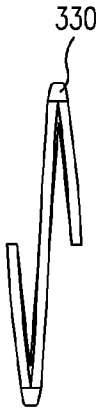
FIG. 39B is a left side elevation view of the slip-ring spring.
Figure 39C:
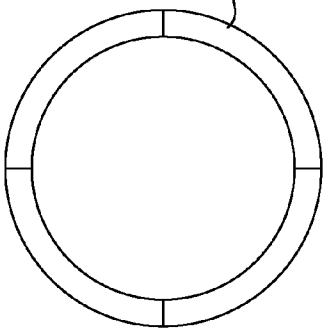
FIG. 39C is a rear end view of the slip-ring spring.
Figure 40:
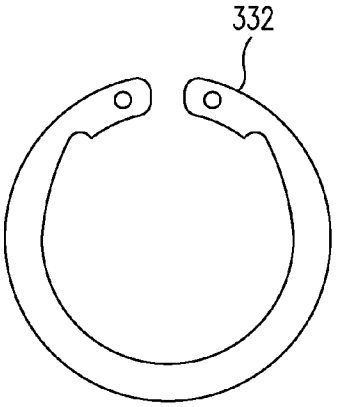
FIG. 40 is a front end elevation view of a snap ring of a type utilized in conjunction with the slip ring of FIGS. 38A-38D.

The slip ring spring 330 used to bias the slip ring 328 forwardly on the barrel nut 326 is illustrated in the upper and left front perspective, left side elevation, rear end views thereof of FIGS. 39A-39C, respectively, and FIG. 40 is a front end elevation view of a snap ring 332 used to retain the slip ring spring 330 on the barrel nut 326 and behind a flange at the front end of the slip ring 328.

Following is a description of an example method for attaching the hand guard 300 to a host firearm using the example hand guard mounting assembly 302. In this example, it is assumed that a barrel 24, barrel nut 326, and slip ring 328 extend longitudinally forward from a receiver of the host firearm. In this regard, the hand guard 300 may be attached to the firearm without requiring removal of slip ring 328.

An elongated tubular housing 306 having a lumen extending between opposite ends of the housing of the type described above and illustrated in, e.g., FIGS. 26A-26E, is provided. As discussed, in some embodiments, the hand guard mounting assembly 302 is coupled to a rear end portion of the housing 306, using, e.g., a plurality of radially extending fasteners 334 (e.g., extending radially inward toward the barrel 24 of the firearm) of the type described herein.

Figure 33:
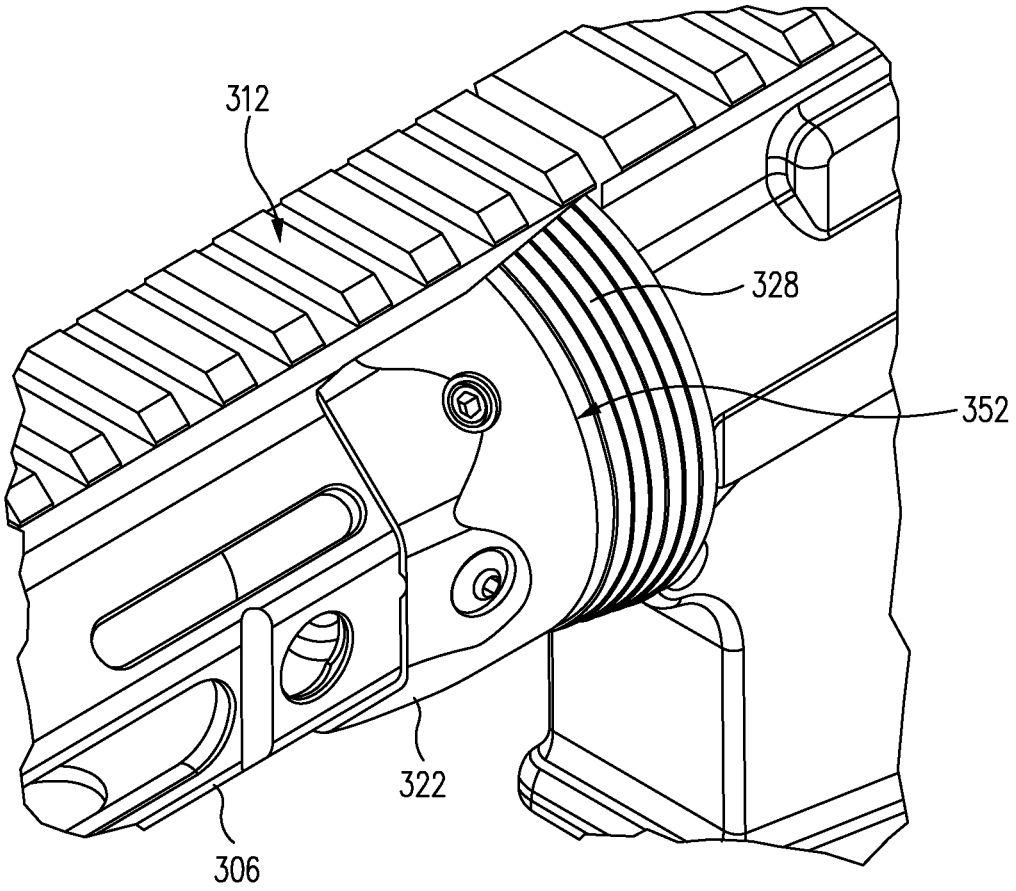
FIG. 33 is a partial perspective view of the example hand guard and mounting assembly therefore, showing a rear end of the mounting assembly disposed in a flush abutment with a front end of the slip ring of the host rifle.

A distal end of the barrel 24 of the firearm is then inserted through the rear end of the mounting assembly 302 and into the lumen of the tubular housing 306 such that the rear end 352 of the barrel nut interface 322 is disposed in flush abutment with a front end of the slip ring 328 of the firearm (see FIGS. 27 and 33), the barrel 24 is disposed concentrically within the lumen of the housing 303, and the gas tube 30 of the firearm is disposed within the cutout 358 in the rear end 352 of the barrel nut interface 322 and the arcuate space 362 in the circumfery of the wedge nut 324.

The mounting assembly 302 is then advanced longitudinally rearward against the slip ring 328 and the bias of the slip ring spring 330 such that the tabs 354 of the barrel nut interface 322 pass through respective ones of the scallops 344 of the flange 335 of the barrel nut 326, the rear face 340 of the flange 335 on the barrel nut 326 is disposed forward of the forward facing surface of the tabs 354 on the barrel nut interface 322, and the front face 338 of the flange 335 is disposed rearward of the rearward facing surface 364 of the wedge ring 324.

The mounting assembly 302 is the rotated circumferentially relative to the receiver of the firearm (e.g., rotated around the barrel 24) until the accessory mounting rail 312 on the upper surface of the tubular housing 306 is aligned substantially perpendicular to a sagittal plane 348 extending through a centerline of the barrel 24 of the firearm, the tines 342 on the flange 335 of the barrel nut 326 are aligned radially with corresponding ones of the indentations 356 in the forward facing surfaces of the tabs 354 of the barrel nut interface 322, and lands 366 on the rearwardly facing surface 364 of the wedge ring 324 are aligned radially with corresponding ones of the scallops 344 in the flange 335 of the barrel nut 326.

Figure 34:
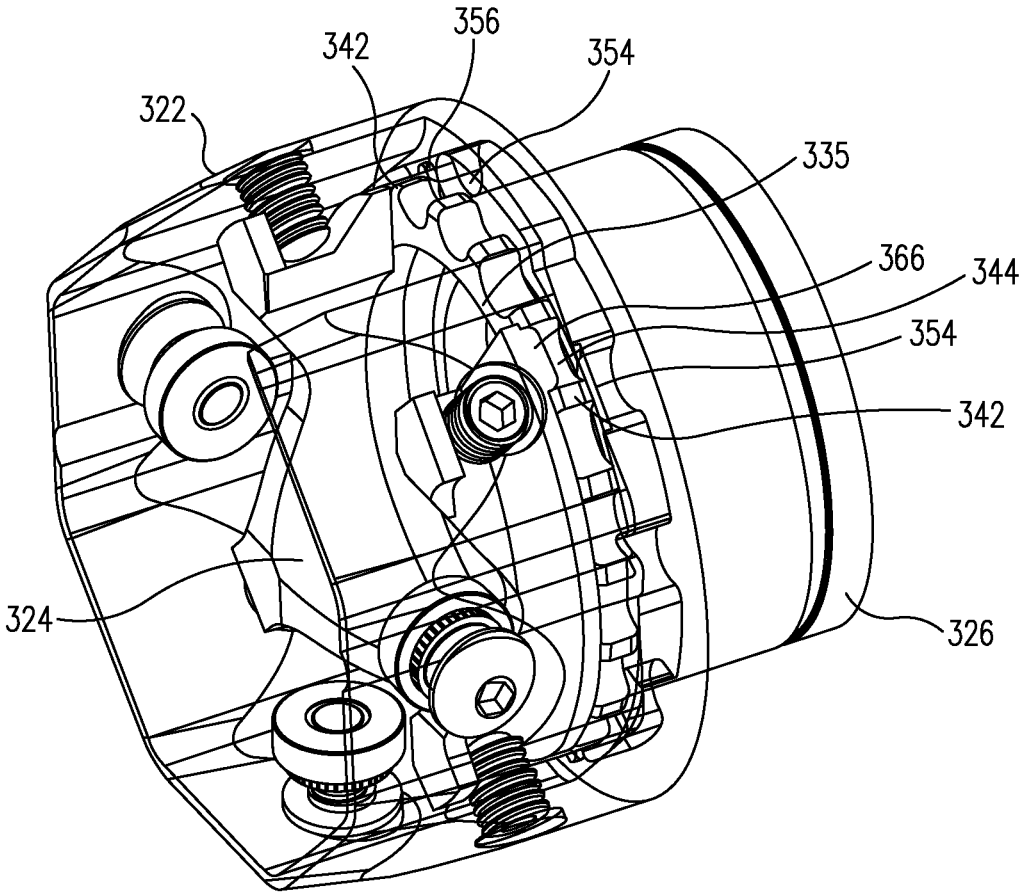
FIG. 34 is an upper left side perspective view of the example hand guard mounting assembly, wherein a portion thereof is rendered transparent to reveal internal components therein, including a wedge ring and a barrel ring of the host rifle.

At this point, the rearward force applied to mounting assembly 302 against the slip ring 328 can be relaxed so as to allow the bias of the slip ring spring 330 to urge the mounting assembly 302 longitudinally forward until tines 342 on the flange 335 of the barrel nut 326 are received within corresponding ones of the indentations 356 in the forward facing surfaces of the tabs 354 of the barrel nut interface 322, and lands 366 on the rearwardly facing surface 364 of the wedge ring 324 are received longitudinally within corresponding ones of the scallops 344 in the flange 335 of the barrel nut 326, thereby locking the mounting assembly 302 and tubular housing 306 against any further, undesirable rotation relative to the barrel 24 and/or the receiver of the firearm. For example, FIG. 34 illustrates barrel nut interface 322, wedge ring 324, and barrel nut 326 in a locked position.

The set screws 374 in the barrel nut interface 322 can then be tightened in a radially inward direction and against corresponding ones of the inclined planes 370 of the wedge ring 324, thereby clamping the flange 335 of the barrel nut 326 firmly between the rearward facing surface 364 of the wedge ring and the forward facing surfaces of tabs 354 of the barrel nut interface 322. As discussed above, when the flange 335 of the barrel nut has been firmly clamped between the opposing surfaces of the wedge ring 324 and the barrel nut interface 322, the hand guard 300 is cantilevered forwardly from the front of the receiver of the firearm, with the barrel 24 disposed concentrically within the lumen of the tubular housing 306, and as discussed above, is prevented from moving, either longitudinally or rotationally relative to the barrel 24 or receiver.

Figure 41:
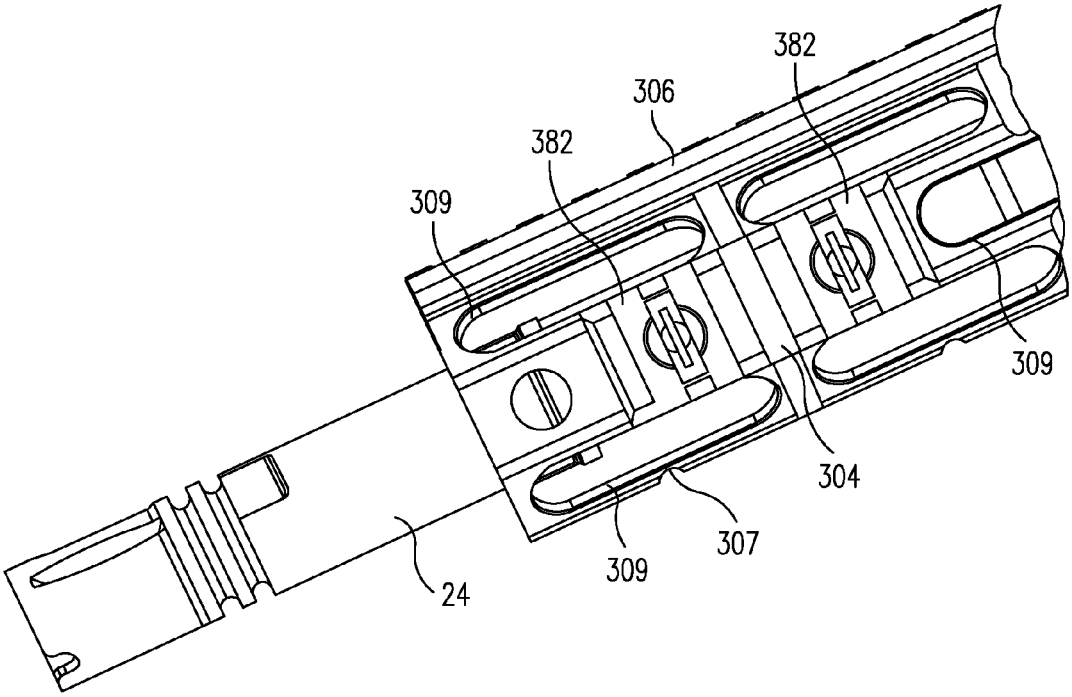
FIG. 41 is a partial top plan view of an example accessory mounting rail shown mounted to the example hand guard of FIG. 24 in accordance with the present disclosure, as seen along the lines of the section 41-41 taken therein.
Figure 42D:
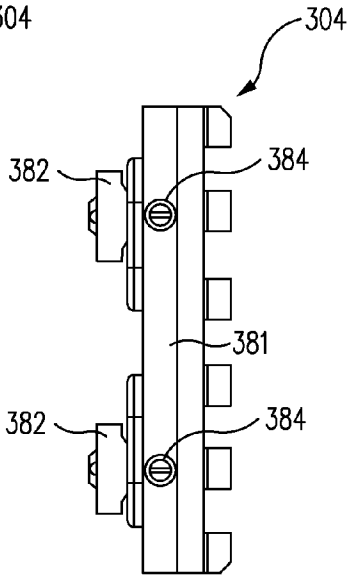
FIG. 42D is a right side elevation view thereof.

As discussed above, in some embodiments, the tubular housing 306 can provide one or more generally flat side walls for the mounting of a variety of firearm accessories, or as illustrated in FIG. 24, an accessory mounting rail 304, such as a Picatinny rail, upon which a firearm accessory, e.g., a light, a telescopic sight, or the like can be mounted. FIG. 41 is a partial top plan view of accessory mounting rail 304 shown mounted to the example hand guard 306 of FIG. 24 in accordance with the present disclosure, as seen along the lines of the section 41-41 taken therein. FIG. 42A is a top plan view of the example accessory mounting rail 304, FIG. 42B is a left side elevation view thereof, FIG. 42C is a bottom plan view thereof, and FIG. 42D is a right side elevation view thereof.

As can be seen in these figures, the example accessory mounting rail 304 comprises an elongated body 381, which in one embodiment, can comprise an extrusion, that is coupled to the associated tubular housing 306 by means of a pair of fasteners 382 (e.g., quarter turn or half turn fasteners in some embodiments) that extend into corresponding apertures 320 in the housing 306.

Figure 42C:
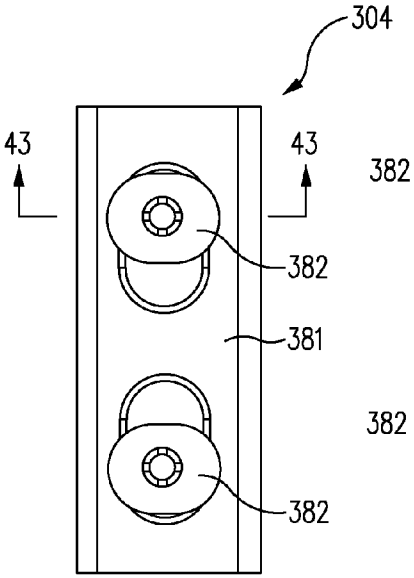
FIG. 42C is a bottom plan view thereof.
Figure 42B:
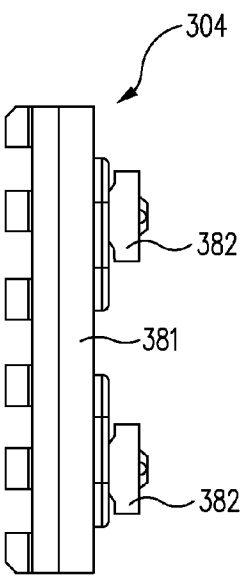
FIG. 42B is a left side elevation view thereof.
Figure 42A:
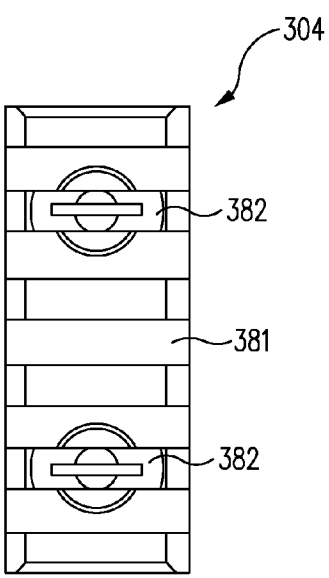
FIG. 42A is a top plan view of the accessory mounting rail.
Figure 44C:
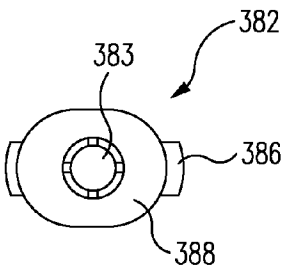
FIG. 44C is a bottom plan view thereof.
Figure 44B:
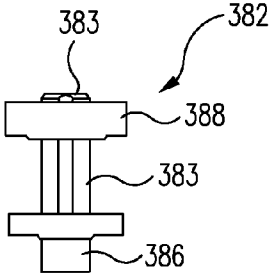
FIG. 44B is a left side elevation view of the fastener.
Figure 44A:
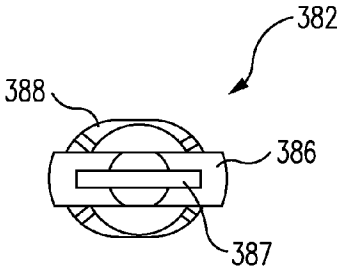
FIG. 44A is a top plan view of the fastener of FIG. 43A.
Figure 43A:
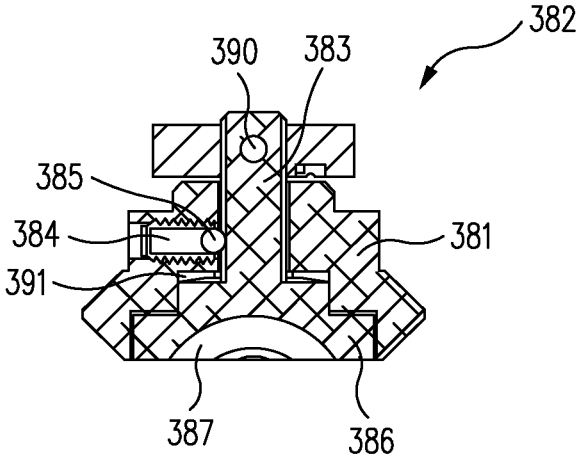
FIG. 43A is a cross-sectional view of the accessory mounting rail and an example fastener used to fasten it to the example hand guard, as seen along the lines of the section 43-43 taken in FIG. 42C.
Figure 43B:
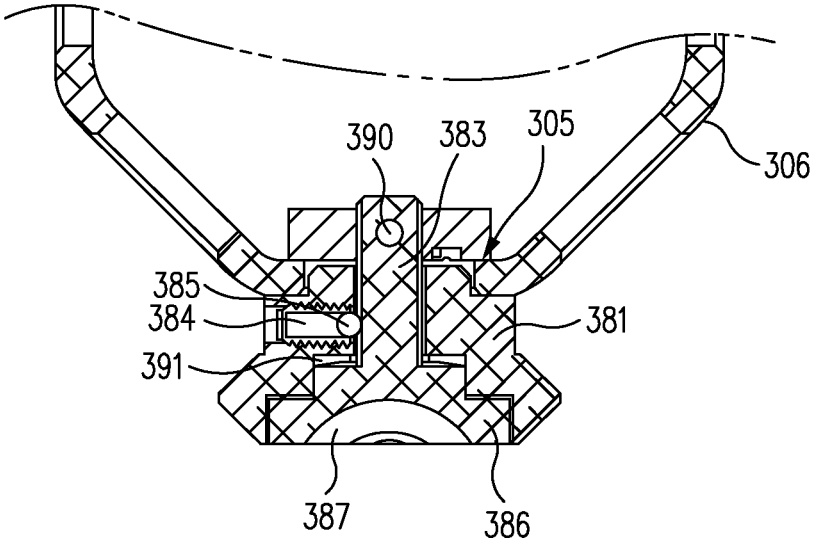
FIG. 43B is a cross-sectional view of the accessory mounting rail and the example fastener, as seen along the lines of the section 43-43 taken in FIG. 42C while the accessory mounting rail is attached to the hand guard.

FIG. 43A is a cross-sectional view of the accessory mounting rail 304 and an example fastener 382 used to fasten it to the example hand guard 300, as seen along the lines of the section 43-43 taken in FIG. 42C. FIG. 43B is a cross-sectional view of the accessory mounting rail 304 and the example fastener 382, as seen along the lines of the section 43-43 taken in FIG. 42C while the accessory mounting rail is attached to the housing 306 of hand guard 300. FIG. 44A is a top plan view of the fastener 382, FIG. 44B is a left side elevation view thereof, and FIG. 44C is a bottom plan view thereof.

As can be seen in these figures, the fastener 382 comprises a shaft 383 rotatably retained within a bore extending through the body 381 of the accessory mounting rail 304. As illustrated in FIGS. 42D and 43, each shaft 383 can be rotatably retained in the body 381 of the rail 304 by a set screw 384 having a ball bearing 385 rollably disposed at an internal end thereof to permit easy rotation of the shaft 383 within its associated bore. The fastener 382 is provided with a head 386 formed at a proximal end of the shaft 383, and the head 386 includes a recess 387 configured to receive a tool for turning the shaft 383. In the particular embodiment illustrated in the figures, the recess 387 comprises a narrow slot having an arcuate bottom that is adapted to receive the edge of a coin, such as a dime, penny, nickel, and/or quarter, and/or a screwdriver. An oval shaped foot 388 is fixed against rotation relative to the shaft 383 at a proximal end thereof by, e.g., a roll pin 390.

In some embodiments, the installation of the rail 380 on the tubular housing 306 of the hand guard 300 involves aligning the long dimension of the heads 386 and the oval feet 388 of the fasteners 382 along the long dimension of the body 381. In this configuration, the rail 304 is placed at the desired longitudinal position on a flat surface of the tubular housing 306 and respective ones of the oval feet 388 of the fasteners 382 are inserted through corresponding apertures 320 in the housing 306. The heads 386 of the fasteners 382 are then turned until the heads 382, and hence the oval feet 388 of the fasteners are disposed perpendicular to the long axis of the body 381, and the upper surfaces of the oval feet 388 are engaged with the inner wall surfaces of the housing 306. As shown in FIGS. 43A-B, in some embodiments, a Belleville disk spring 391 may be provided to bias the fastener 382 outward (e.g., by pushing head 386 downward against an inside surface 305 of housing 306 in FIG. 43B), to clamp on to housing 306.

Figure 45:
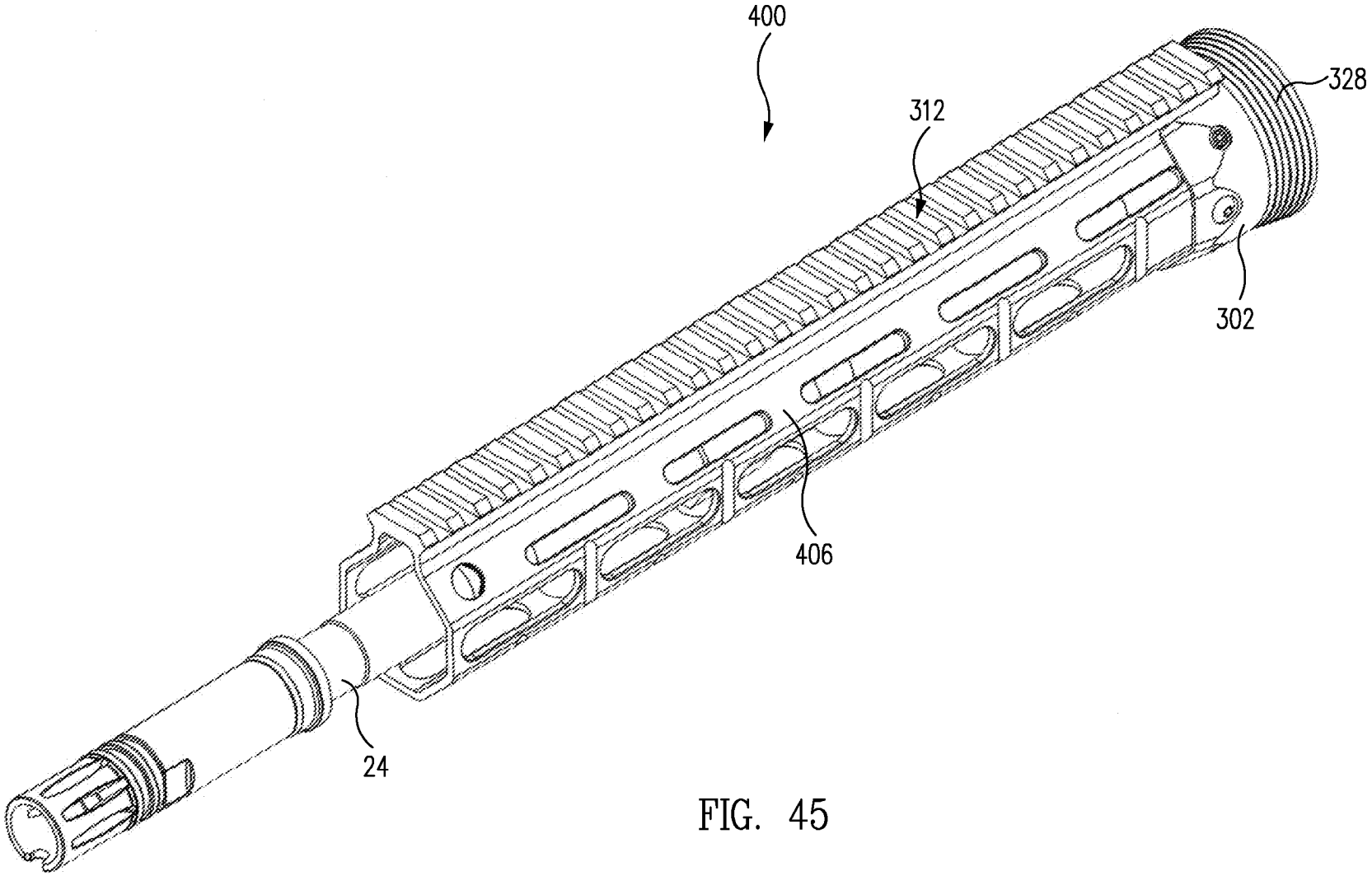
FIG. 45 is an upper, front, left side perspective view of another example hand guard of a type similar to that of FIG. 24, in accordance with the present disclosure.

FIG. 45 is an upper, front, left side perspective view of another example hand guard 400 of a type similar to that of FIG. 24, in accordance with the present disclosure. As may be seen in FIG. 45, the example hand guard 400 includes many of the same features and mounting capabilities as the third example hand guard 300 described above, except that it has a housing 406 that is shorter in length than housing 306, and therefore adapted to firearms having shorter barrels 24, e.g., an M4 carbine rifle. Accordingly, the various hand guards of the present disclosure may be modified as appropriate for use with various types and lengths of weapons. Moreover, any of the various features set forth in the present disclosure (e.g., with regard to the various hand guards and mounting hardware) may be combined with each other, in whole or in part, as may be desired for various applications.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention, and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but rather, should be accorded the widest possible scope consistent with the principles and features disclosed herein.

What is claimed is:

1. A hand guard for a firearm that includes a barrel and a barrel nut extending longitudinally forward from a receiver of the firearm, the hand guard comprising:

an elongated tubular housing having a lumen extending between opposite ends of the housing;

a mounting assembly coupled concentrically to a rear end portion of the housing, the mounting assembly including a pair of opposing transverse surfaces respectively disposed on opposite sides of a transverse flange located on a front end of the barrel nut, at least one of the transverse surfaces being longitudinally moveable toward the other transverse surface so as to clamp the flange firmly between the two transverse surfaces and such that the barrel of the firearm is disposed concentrically within the lumen of the housing; and an urging mechanism comprising:

an inclined plane disposed in front of a rearward facing one of the transverse surfaces, and a radially extending set screw disposed above the inclined plane and arranged to urge the rearward facing transverse surface longitudinally toward the other transverse surface when an end of the set screw is radially advanced against the inclined plane.

2. The hand guard of claim 1, wherein:

the flange of the barrel nut includes at least one tine extending radially outward from it, and a forward facing one of the transverse surfaces comprises a barrel nut interface and includes at least one indentation configured to receive the at least one tine longitudinally therein.

3. The hand guard of claim 1, wherein:

the flange of the barrel nut includes at least one scallop extending radially into it; and a rearward facing one of the transverse surfaces comprises a wedge ring and includes at least one rearwardly extending land configured to engage longitudinally within the at least one scallop.

4. The hand guard of claim 1, wherein the tubular housing comprises an extrusion.

5. The hand guard of claim 1, wherein the tubular housing includes at least one side wall defining a firearm accessory mounting rail.

6. The hand guard of claim 1, wherein the tubular housing is polygonal in cross-section.

7. The hand guard of claim 6, wherein the tubular housing has a generally octagonal cross-section.

8. The hand guard of claim 1, wherein the tubular housing comprises an aluminum alloy.

9. The hand guard of claim 1, wherein:

the tubular housing includes at least one radially extending threaded aperture disposed in the rear end portion thereof, and the mounting assembly is coupled to the tubular housing by at least one threaded fastener extending radially through the mounting assembly and into the at least one threaded aperture.

10. A method comprising:

attaching a hand guard to a firearm that includes a barrel and a barrel nut extending longitudinally forward from a receiver of the firearm, the hand guard comprising:

an elongated tubular housing having a lumen extending between opposite ends of the housing;

a mounting assembly coupled concentrically to a rear end portion of the housing, the mounting assembly including a pair of opposing transverse surfaces respectively disposed on opposite sides of a transverse flange located on a front end of the barrel nut, at least one of the transverse surfaces being longitudinally moveable toward the other transverse surface so as to clamp the flange firmly between the two transverse surfaces and such that the barrel of the firearm is disposed concentrically within the lumen of the housing; and an urging mechanism comprising:

an inclined plane disposed in front of a rearward facing one of the transverse surfaces, and a radially extending set screw disposed above the inclined plane and arranged to urge the rearward facing transverse surface longitudinally toward the other transverse surface when an end of the set screw is radially advanced against the inclined plane.

11. The method of claim 10, wherein:

the flange of the barrel nut includes at least one tine extending radially outward from it, and a forward facing one of the transverse surfaces comprises a barrel nut interface and includes at least one indentation configured to receive the at least one tine longitudinally therein.

12. The method of claim 10, wherein:

the flange of the barrel nut includes at least one scallop extending radially into it; and a rearward facing one of the transverse surfaces comprises a wedge ring and includes at least one rearwardly extending land configured to engage longitudinally within the at least one scallop.

13. The method of claim 10, wherein the tubular housing comprises an extrusion.

14. The method of claim 10, wherein the tubular housing includes at least one side wall defining a firearm accessory mounting rail.

15. The method of claim 10, wherein the tubular housing is polygonal in cross-section.

16. The method of claim 15, wherein the tubular housing has a generally octagonal cross-section.

17. The method of claim 10, wherein the tubular housing comprises an aluminum alloy.

18. The method of claim 10, wherein:

the tubular housing includes at least one radially extending threaded aperture disposed in the rear end portion thereof, and the mounting assembly is coupled to the tubular housing by at least one threaded fastener extending radially through the mounting assembly and into the at least one threaded aperture.

19. The method of claim 10, further comprising coupling an accessory mounting rail to a longitudinal surface of the tubular housing by at least one fastener, wherein the fastener comprises:

a shaft rotatably retained within a bore through the accessory mounting rail;

a generally planar head formed at a proximal end of the shaft, the head including an indentation configured to receive a tool for turning the shaft; and an oval shaped foot fixed against rotation at a proximal end of the shaft.

20. The method of claim 19, wherein the indentation is configured to receive the edge of a coin.

* * * * *